US007699425B2

(12) United States Patent
Tanaka et al.

(10) Patent No.: US 7,699,425 B2
(45) Date of Patent: Apr. 20, 2010

(54) PRINTING APPARATUS AND METHOD FOR ESTIMATING AMOUNT OF INK

(75) Inventors: Hirokazu Tanaka, Kawasaki (JP); Hidehiko Kanda, Yokohama (JP); Atsushi Sakamoto, Kawasaki (JP); Jiro Moriyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 195 days.

(21) Appl. No.: 12/113,812

(22) Filed: May 1, 2008

(65) Prior Publication Data

US 2008/0278530 A1 Nov. 13, 2008

(30) Foreign Application Priority Data

May 8, 2007 (JP) ..... 2007-123666

(51) Int. Cl.
*B41J 29/38* (2006.01)

(52) U.S. Cl. ..... 347/17; 347/7; 347/14

(58) Field of Classification Search ..... 347/7, 347/17, 19, 22–23, 35
See application file for complete search history.

(56) References Cited

U.S. PATENT DOCUMENTS

| | | | | |
|---|---|---|---|---|
| 5,508,722 | A | 4/1996 | Saito et al. | 347/17 |
| 5,731,826 | A | 3/1998 | Hirano | 347/19 |
| 5,880,751 | A | 3/1999 | Nishikori et al. | 347/14 |
| 6,123,403 | A | 9/2000 | Makino et al. | 347/5 |
| 7,021,731 | B2 * | 4/2006 | Mizoguchi et al. | 347/7 |
| 7,380,900 | B2 | 6/2008 | Kanda et al. | 347/19 |

FOREIGN PATENT DOCUMENTS

| | | |
|---|---|---|
| JP | 3-259662 | 11/1991 |
| JP | 5-318765 | 12/1993 |
| JP | 7-32608 | 2/1995 |
| JP | 7-323552 | 12/1995 |
| JP | 9-94947 | 4/1997 |
| JP | 11-129496 | 5/1999 |

* cited by examiner

*Primary Examiner*—Thinh H Nguyen
(74) *Attorney, Agent, or Firm*—Fitzpatrick, Cella, Harper & Scinto

(57) ABSTRACT

The present invention provides a printing apparatus which is capable of estimate an amount of remaining ink with high accuracy by using ejection of ink from a printing head while restraining a consumption of ink during the estimation of the remaining ink amount, and also provides a method for estimating an amount of ink. An amount of ink ejected per unit time during the ink ejection for estimation of the remaining ink amount is set to be larger than an amount of ink ejected per unit time during printing.

11 Claims, 23 Drawing Sheets

——-- REMAINING INK AMOUNT : 1g

-------- REMAINING INK AMOUNT : 3g

——— REMAINING INK AMOUNT : 10g

| NUMBER OF DRIVING PASSES \ PAPER SIZE | A4-SIZE VERSION | L VERSION | NAME CARD |
|---|---|---|---|
| 1-PASS PRINTING | 3.0g | 2.0g | 1.5g |
| 6-PASS PRINTING | 2.0g | 1.3g | 1.0g |
| 12-PASS PRINTING | 1.0g | 0.7g | 0.5g |

FIG.13

EJECTION NUMBER TABLE

| NUMBER OF DRIVING PASSES \ PAPER SIZE | A4-SIZE VERSION | L VERSION | NAME CARD |
|---|---|---|---|
| 1-PASS PRINTING | 1000 DROPLETS | 700 DROPLETS | 590 DROPLETS |
| 6-PASS PRINTING | 700 DROPLETS | 550 DROPLETS | 500 DROPLETS |
| 12-PASS PRINTING | 500 DROPLETS | 460 DROPLETS | 440 DROPLETS |

FIG.14

TEMPERATURE DETERMINATION TABLE

| NUMBER OF INK DROPLETS TO BE EJECTED | DETERMINATION TEMPERATURE FOR REMAINING INK AMOUNT |
|---|---|
| 1000 DROPLETS | 30℃ |
| 700 DROPLETS | 26℃ |
| 590 DROPLETS | 24℃ |
| 550 DROPLETS | 23℃ |
| 500 DROPLETS | 22℃ |
| 460 DROPLETS | 22℃ |
| 440 DROPLETS | 21℃ |

FIG.15

| ENVIRONMENT TEMPERATURE (envT) | DRIVING PULSE | PRE-PULSE (us) | INTERVAL (us) | MAIN PULSE (us) |
|---|---|---|---|---|
| envT <18℃ | PWM4 | 0.60 | 1.82 | 0.86 |
| 18℃ ≦ envT <23℃ | PWM3 | 0.50 | 1.86 | 0.92 |
| 23℃ ≦ envT <28℃ | PWM2 | 0.40 | 1.90 | 0.98 |
| 28℃ ≦ envT | PWM1 | 0.20 | 1.94 | 1.04 |

PRINTING APPARATUS AND METHOD FOR ESTIMATING AMOUNT OF INK

BACKGROUND OF THE INVENTION

1. Field of the Invention

The present invention relates to a printing apparatus that is capable of estimating an amount of ink available for supply to a printing head, and a method for estimating an amount of ink.

2. Description of the Related Art

In recent years, in the field of printing apparatuses, such as printers, copiers and facsimiles, an ink-jet printing system employing a printing head capable of ejecting minuscule droplets of ink in response to a high-frequency driving signal has been widely used. In an ink-jet printing system which requires a user to replace an ink tank, it is important to notify the user of depletion of the ink in the ink tank. Especially, for devices, such as facsimiles, which do not allow transmitted data to be kept by a user, it should be avoided to perform a printing operation with no ink being ejected from the printing head (empty printing) due to depletion of ink. For this reason, it is desired to enhance the accuracy in estimating an amount of ink available for supply to the printing head (hereafter also referred to as "remaining ink amount").

Japanese Patent Laid-Open No. Hei 03-259662 discloses a method for estimating a remaining ink amount on the basis of the temperature of a printing head and the value of a current flowing through the printing head. Japanese Patent Laid-Open No. Hei 07-032608 discloses a method for estimating a remaining ink amount on the basis of vibration of a vibration plate which is being sprayed with ink. Japanese Patent Laid-Open No. Hei 09-094947 discloses a method for estimating a remaining ink amount on the basis of a change in the current value caused when ejected ink is passing between optical elements. The common point among these methods is to detect whether or not ink has actually been ejected from a printing head by using some method while causing the printing head to operate in response to a signal instructing the printing head to eject ink. Moreover, another common point is to determine that the remaining ink amount is zero when ink is not ejected from the printing head. Being capable of detecting whether or not ink is actually ejected from the printing head, these methods for estimating an amount of ink achieve high accuracy in estimating a remaining ink amount.

However, although a remaining ink amount can be estimated with high accuracy in these methods, it is required that ink be actually ejected from the printing head in order to estimate the remaining ink amount. As a result, the amount of ink available for printing is reduced by that consumption needed for the estimation process.

SUMMARY OF THE INVENTION

The present invention provides: a printing apparatus that is capable of estimating a remaining ink amount with high accuracy by using ink ejection from a printing head while restraining the consumption of ink during the estimation; and a method for estimating an amount of ink.

In the first aspect of the present invention, there is provided a printing apparatus for performing printing on a printing medium by ejecting ink supplied by an ink tank from ejection openings of a printing head, comprising: an acquisition unit that acquires a temperature change of the printing head between before and after ejection of ink not contributing to printing; and an estimation unit that estimates a remaining ink amount based on the acquired temperature change of the printing head, wherein an amount of ink ejected per unit time during the ejection of ink not contributing to printing is larger than an amount of ink ejected per unit time during the printing.

In the second aspect of the present invention, there is provided an estimation method of an ink amount, in a printing apparatus for performing printing on a printing medium by ejecting ink supplied by an ink tank from ejection openings of a printing head, for estimating an amount of ink available for supply to the ejection openings, the method comprising: an acquisition process for acquiring a temperature change of the printing head between before and after the ejection of ink not contributing to printing; and an estimation process for estimating a remaining ink amount on the basis of the temperature change of the printing head which is acquired in said acquisition process, and wherein an amount of ink ejected per unit time during the ejection of ink not contributing to printing is larger than an amount of ink ejected per unit time during the printing.

According to the present invention, the amount of ink ejected per unit time from the printing head is set to be larger than that during the printing of an image, when the ink amount is estimated on the basis of the ink ejection from the printing head. In this configuration, it is possible to estimate an amount of ink with high accuracy while restraining the consumption of ink. To be more specific, the present invention makes use of the fact that the state of the ink tank or the printing head changes (which is observed as a change in the amount of ink ejected when ink is ejected) as the amount of ink available for an ejection opening of the printing head decreases. Furthermore, the present invention causes such a change in the state to occur efficiently. Thereby, it becomes possible to achieve a highly accurate estimation of an amount of ink while restraining the consumption of ink.

Further features of the present invention will become apparent from the following description of exemplary embodiments (with reference to the attached drawings).

BRIEF DESCRIPTION OF THE DRAWINGS

FIG. 13 is an explanatory drawing of the relationship among the number of printing passes, a paper size, and a remaining ink amount;

FIG. 14 is an explanatory drawing of a ejection number table showing the relationship among the number of printing passes, a paper size, and the number of ink droplets to be ejected;

FIG. 15 is an explanatory drawing of a temperature determination table showing the relationship between the number of ink droplets to be ejected and a determination temperature for a remaining ink amount;

FIG. 17 is a diagram showing a relation between FIG. 17A and FIG. 17B.

DESCRIPTION OF THE EMBODIMENTS

Preferable embodiments of the present invention will be described in detail below by referring to attached drawings.

In this specification, "printing" not only refers to the formation of significant information such as letters and drawings, but also refers to the formation of no significant information. In other words, "printing" widely includes both cases where images, designs, patterns, and the like are formed on a printing medium and where the medium is processed, regardless of whether or not the resultant of the "printing" action is actualized so as to be visually perceived by people.

In addition, a "printing medium" not only refers to paper, which is used in regular printing apparatuses, but also widely refers to various materials, such as cloth, plastic film, metal plate, glass, ceramic, wood, and leather, which are capable of receiving ink to be printed thereon.

Moreover, "ink" (which may also be referred to as "liquid" in some cases) should be interpreted as widely as the definition of the "printing" described above. Therefore, "ink (liquid)" refers to liquids which are used, upon being applied on a printing medium, for formation of images, designs, patterns, and the like, for processing of the printing medium, and for treatment of ink (for example, for coagulation or insolubilization of a coloring agent in ink applied to the printing medium).

Furthermore, a "nozzle" (which may also be referred to as "printing element" or "printing component" in some cases) refers, as a whole, to an ejection opening, a liquid pathway connected thereto, and an element which generates energy utilized for ink ejection, unless otherwise noted.

First Embodiment

Figure 2A:
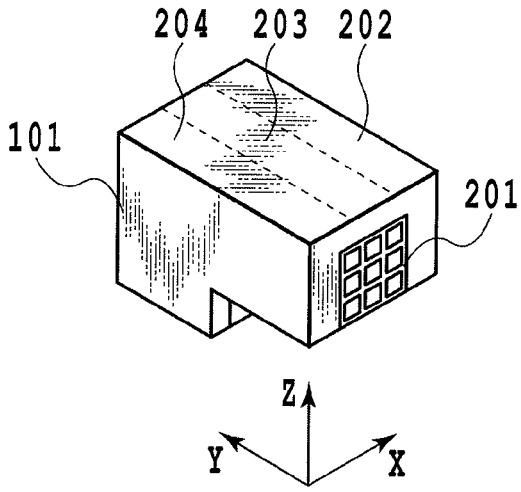
FIG. 2A is a perspective view of the printing head in FIG. 1A.
Figure 2B:
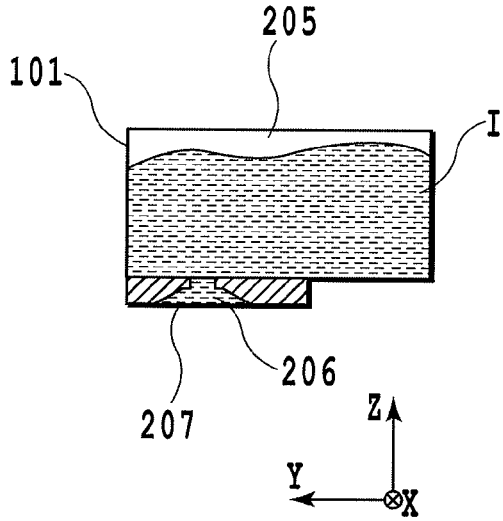
FIG. 2B is a cross-sectional view of the printing head.
Figure 2C:
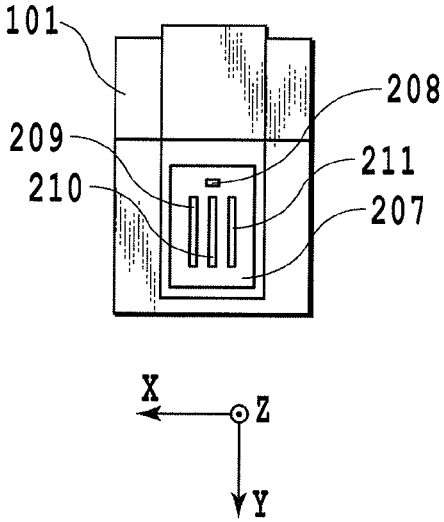
FIG. 2C is a bottom view of the printing head.
Figure 2D:
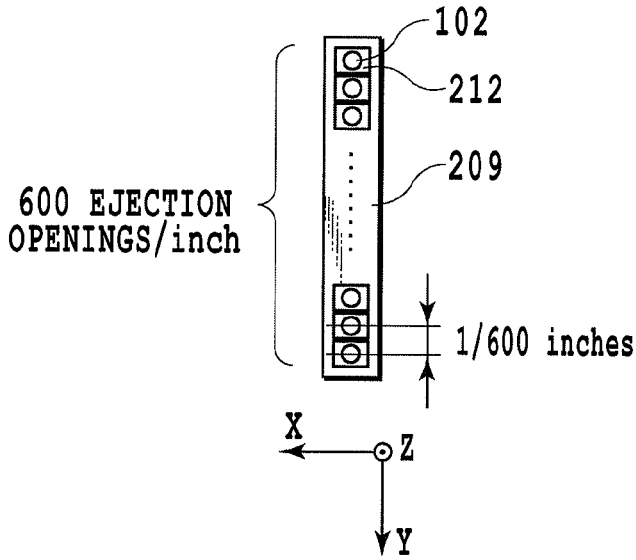
FIG. 2D is an enlarged view of a nozzle part of the printing head.
Figure 3:
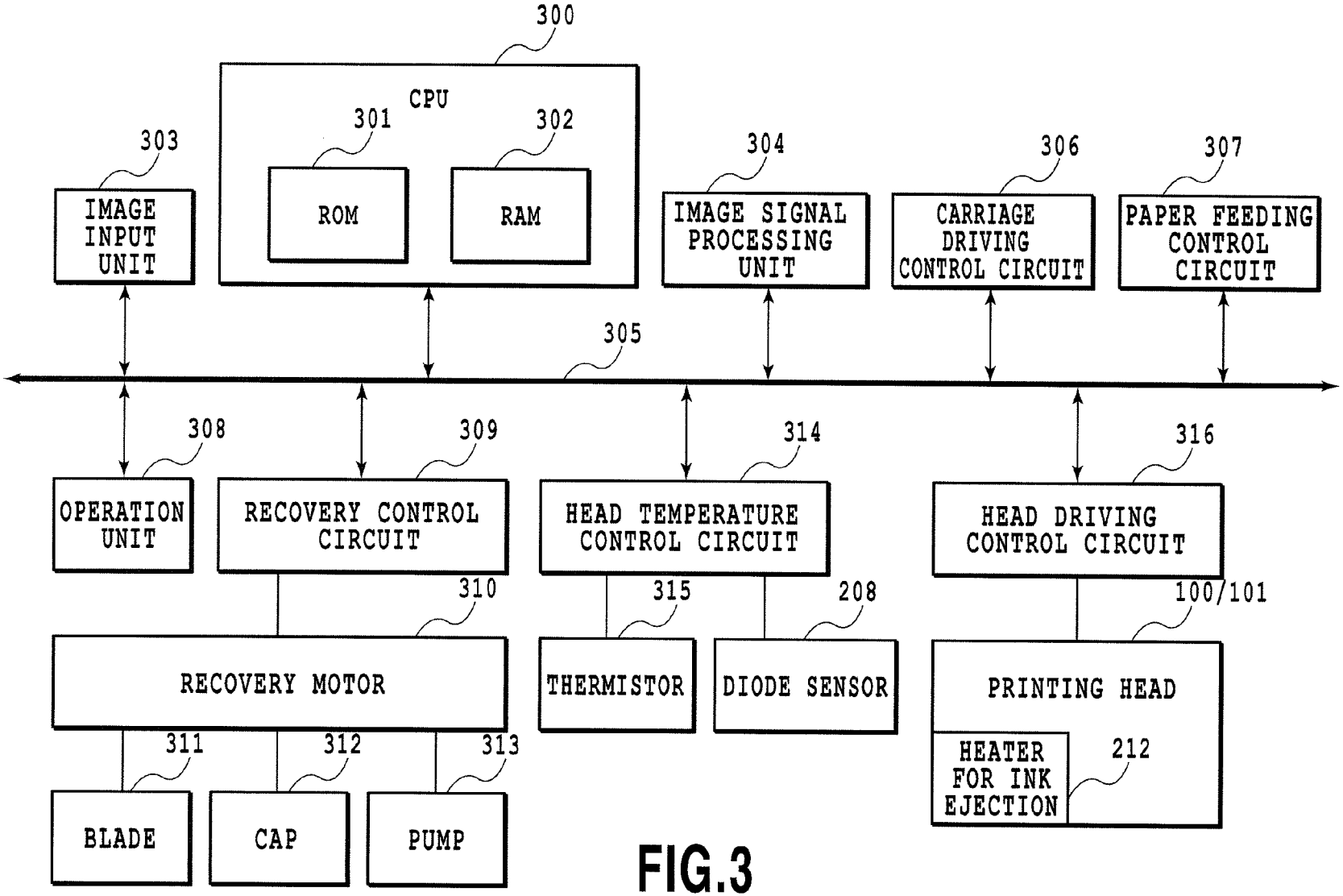
FIG. 3 is a block diagram of a control system of the printing apparatus in FIG. 1A.

FIGS. 1 to 3 are drawings for describing a basic configuration of the printing apparatus in the present embodiment.

Figure 1A:
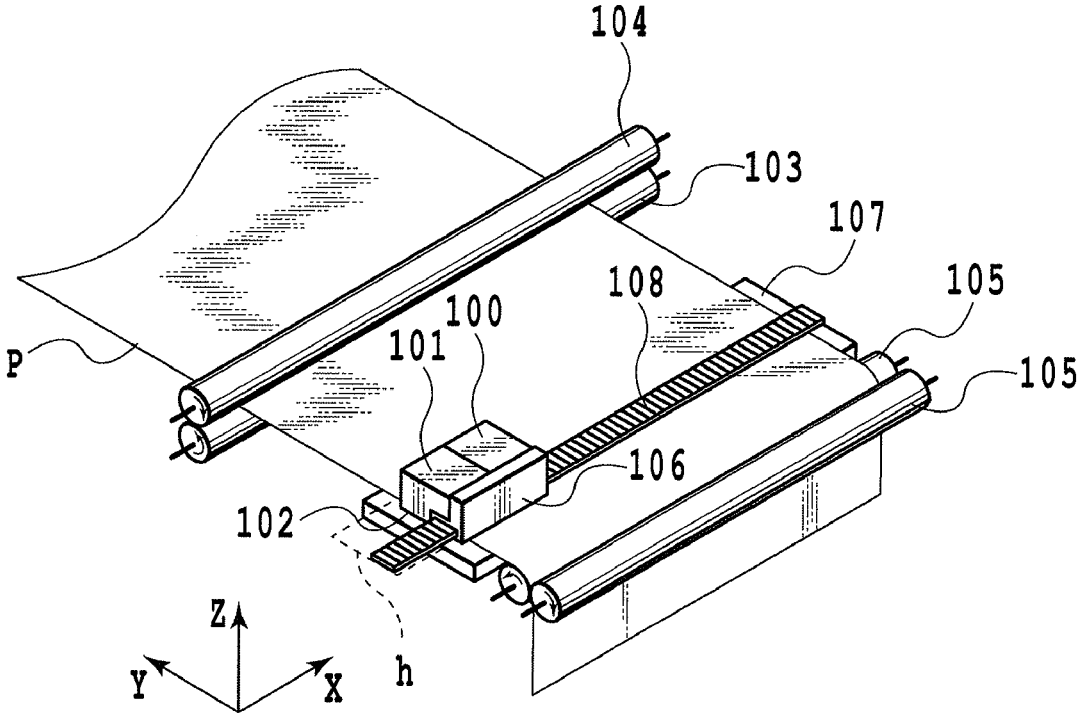
FIG. 1A is a schematic perspective view of a printing apparatus according to a first embodiment of the present invention.
Figure 1B:
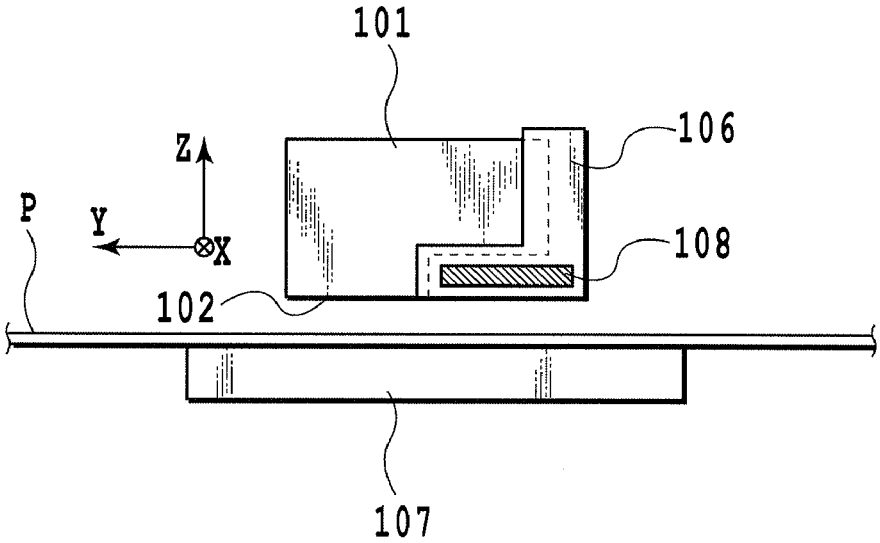
FIG. 1B is a lateral view of a printing head in FIG. 1A.

FIG. 1A is a perspective view of the printing apparatus, and FIG. 1B is a lateral view of a printing head in FIG. 1A. In FIG. 1A and FIG. 1B, 100 and 101 are printing heads which have been integrated with ink tanks. The printing heads 100 and 101 are not necessarily integrated with an ink tank as in the present embodiment, and a configuration in which the printing heads are separable from an ink tank may be adopted.

The ink tank located in the printing head 100 accommodates a black ink, a light cyan ink, and a light magenta ink, while the ink tank located in the printing head 101 accommodates a cyan ink, a magenta ink, and a yellow ink. The printing heads 100 and 101 have the same configuration except for the inks they accommodate in the ink tanks. The printing heads 100 and 101 include multiple ejection openings 102 arranged to correspond with each of the color inks. Reference numeral 103 denotes a conveying roller, and 104 denotes an auxiliary roller. These rollers convey a printing medium P in the direction indicated by an arrow Y while cooperatively holding down the printing medium P and rotating in the directions indicated by arrows. Reference numeral 105 denotes a paper feeding roller for holding down the printing medium P as the conveying roller 103 and the auxiliary roller 104 do, as well as for feeding the printing medium P. Reference numeral 106 denotes a carriage which is capable of carrying the printing heads 100 and 101, and which reciprocates along a main scanning direction indicated by an arrow X during printing. The carriage 106 stands by at a position (home position) h indicated by a dotted line in FIG. 1A when not being engaged in printing or when performing a recovery operation of the printing heads. The maximum size of printable printing media in the printing apparatus of the present embodiment is the A4-size version. Reference numeral 107 denotes a platen which stably supports the printing medium P in a printing position. Reference numeral 108 denotes a carriage belt used for moving the carriage 106 in the main scanning direction.

FIGS. 2A to 2D illustrate the configuration of the printing head. Since the printing heads 100 and 101 have the same configuration, the configuration of the printing head 101 will be described below as a representative example of both printing heads. FIG. 2A is a perspective view of the printing head 101, FIG. 2B is a cross-sectional view of the printing head 101, FIG. 2C is a bottom view of the printing head 101 viewed from a Z direction, and FIG. 2D is an enlarged view around the ejection openings in FIG. 2C. In FIG. 2A, reference numeral 201 denotes a contact pad. Through this contact pad 201, the printing head receives a printing signal from the main body of the printing apparatus and electricity required for driving the printing head. In FIG. 2A, the broken lines indicate the inner walls of the printing head. Ink tank compartments 202, 203, and 204, which are separated by the inner walls, are filled with 10 g each of a cyan ink, a magenta ink, and a yellow ink, respectively. The printing heads 100 and 101, as mentioned above, have the same configuration, such as the structure of the ink tank compartments, except for ink colors in the compartments.

FIG. 2B is the cross-sectional view of the cyan ink tank compartment 202. Reference numeral 205 denotes an ink absorber contained in the ink tank compartment 202, 206 denotes an ink flow path, and 207 denotes a printing head chip. Ink I which is retained in the ink absorber 205 is supplied to the printing head chip 207 via the ink flow path 206. In FIG. 2C, the printing head chip 207 is provided with a diode sensor 208 for detecting the temperature of a printing head substrate. Since it is difficult to directly detect the temperature of the ink in the printing head, the temperature of the printing head substrate (hereafter referred to as "printing head temperature") is detected, and the printing head temperature is commonly used as the temperature of the ink. As for the configuration for detection of printing head temperature, in addition to the configuration employing the diode sensor 208, a configuration utilizing, for example, a metal thin-film sensor or the like may be employed. Reference numeral 209 denotes a line of ejection openings for ejecting the cyan ink, 210 denotes a line of ejection openings for ejecting the magenta ink, and 211 denotes a line of ejection openings for ejecting the yellow ink.

FIG. 2D is the enlarged view of the line 209 of ejection openings for ejecting the cyan ink (hereafter referred to as "cyan ejection openings line"). In FIG. 2D, the multiple ejection openings 102 are arranged on the cyan ejection openings line 209, and a heater 212 is provided on the underside (in the Z direction) of each of the ejection openings 102. Heat generated from the heaters 212 generates bubbles in the ink, and, by utilizing the foaming energy thus generated, the ink can be ejected from the ejection openings 102. In the present embodiment, the number of the ejection openings 102 arranged on the cyan ejection openings line 209 is 600 (for 600 nozzles), and the distance between the ejection openings is 1/600 inches. In such a configuration, the printing pixel density in the main scanning direction is 600 dpi. Furthermore, in the printing head, one ink droplet ejected from the ejection openings 102 is approximately 2 pl. In the present embodiment, a maximum driving frequency of the heater 212 for ejecting the ink droplet (hereafter referred to as "maximum ejection frequency") is set to 24 kHz; however, the optimal maximum ejection frequency for printing is 12 kHz. When printing is performed with ink droplets at intervals of 1,200 dpi in a main scanning direction, the moving velocity of the carriage 106 carrying the printing heads 100 and 101 in the main scanning direction is 10 inches per second according to a formula shown below.

$$12{,}000\ (\text{dots/sec})/1{,}200\ (\text{dots/inch})=10\ \text{inches/sec}$$

FIG. 3 is a block diagram of a control system of the printing apparatus. Components in the control system of the present embodiment can be roughly classified into software control means and hardware processing means. The software control means includes processing means, such as an image input unit 303, an image signal processing unit 304, and a central processing unit (CPU) 300, which are capable of accessing a main bus line 305. Meanwhile, the hardware processing means includes processing means, such as an operation unit 308, a recovery control circuit 309, a head temperature control circuit 314, a head driving control circuit 316, a carriage driving control circuit 306, and a paper feeding control circuit 307. The CPU 300, which includes a read-only memory (ROM) 301 and a random access memory (RAM) 302, drives the heaters 212 for ejecting ink provided in the printing heads 100 and 101 by assigning appropriate printing conditions for input information. A program for executing a recovery processing of the printing heads according to a recovery timing chart is stored in the RAM 302. As needs arise, the program provides recovery conditions, such as conditions for preliminary ejection, to the recovery control circuit 309, the printing heads 100 and 101, and the like.

The recovery processing is carried out to maintain preferable conditions for ejecting ink from the printing heads. In the present embodiment, the recovery processing includes preliminary ejection, suction recovery processing, and wiping. In the preliminary ejection, ink not contributing to in image printing is ejected from the ejection openings of the printing head towards the inside of a cap 312, which will be described later. In the suction recovery processing, ink not contributing to image printing is discharged by suction from the ejection openings of the printing head into the cap 312 while a negative pressure is being applied to the inside of the cap 312 from a suction pump 313, which will be described later. The wiping is a process for wiping the surface in which the ejection openings are formed (ejection openings formation surface) with a cleaning blade 311, which will be described later.

The image input unit 303 receives image data, commands, status signals, and the like, from an external apparatus (host apparatus) connected to the printing apparatus. A recovery motor 310 drives the printing heads 100 and 101, the cleaning blade 311, the cap 312, and the suction pump 313 for performing the recovery processing. The head driving control circuit 316 drives the heaters 212 on the printing heads 100 and 101 on the basis of output values of a thermistor 315 which detects the temperature around the printing apparatus and of the diode sensor 208 which detects the printing head temperature. The head driving control circuit 316 adjusts the ink temperature for ink ejection for printing, preliminary ejection, and incubation control, by drive-controlling the printing heads 100 and 101.

Figure 4:
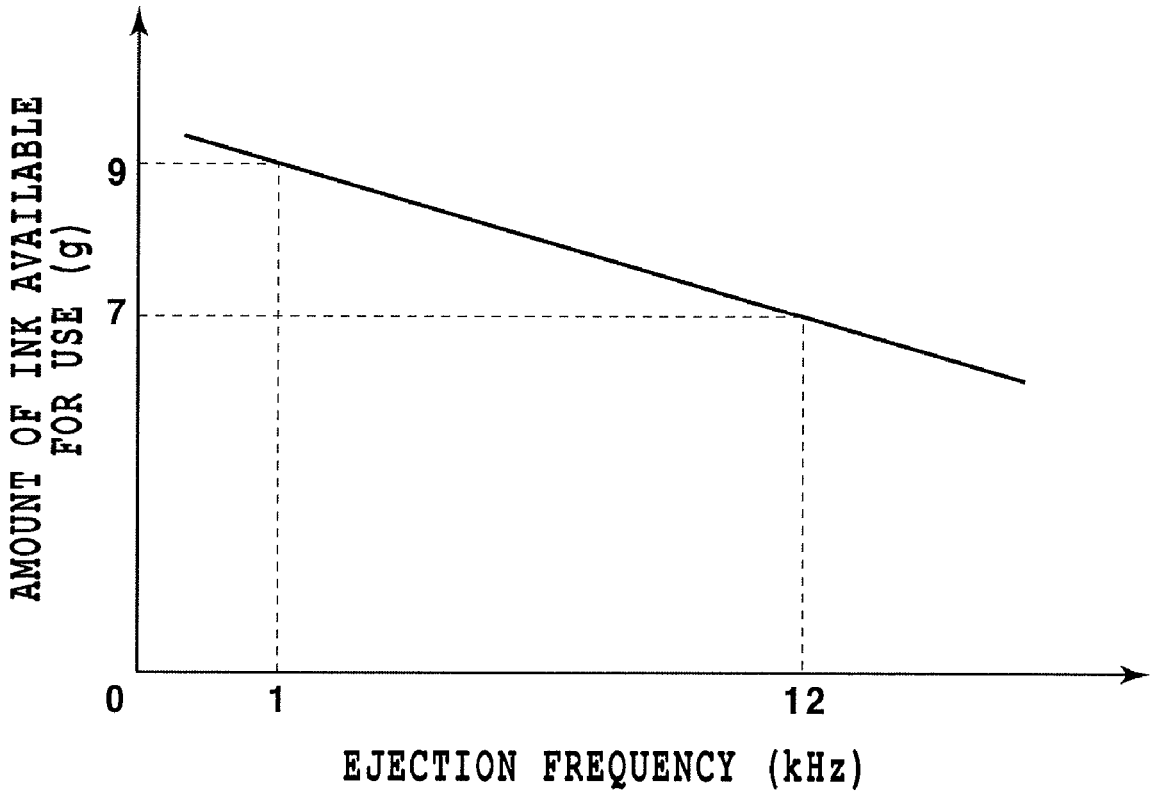
FIG. 4 is an explanatory drawing of the relationship between a frequency of ink ejection and an amount of ink available.

FIG. 4 is an explanatory drawing of the relationship, in the printing head 101, between a frequency of ejecting a cyan ink and an amount of a cyan ink available. A magenta ink and a yellow ink have the same properties as a cyan ink. In the case where ink is being continuously ejected from the 600 nozzles at an ejection frequency of 12 kHz, an amount of ink available for printing is 7 g for 10 g of ink injected in the ink tank. In the meantime, in the case where ink is being continuously ejected from the 600 nozzles at an ejection frequency of 1 kHz, the amount of ink available is 9 g. One of the main reasons for such a difference in an amount of ink available for printing will be explained in the following section.

In general, in a non-ejection state in which no ink is ejected from the ejection openings of the printing head, the ink in the ink tank is held by a negative pressure producing member, such as the absorber 205, so that the ink is not spilled out from the ejection openings. To be more specific, when the ink in the ink tank is applied with a negative pressure, the ink in the printing head is also applied with a pressure which pulls the ink towards the ink tank side (hereafter referred to as "negative pressure"). When the amount of the ink in the ink tank is reduced after printing, the negative pressure on the ink tends to increase gradually. In the case where the negative pressure on the ink becomes too high, the ink in the printing head is strongly pulled towards the ink tank; thus, a less amount of ink is supplied from the ink tank to the ejection openings in some case. In such a case, the ink may not be able to be ejected from the ejection openings even if there is some ink remained in the ink tank.

Furthermore, such a negative pressure on ink in the ink tank also changes according to an amount of ink ejected from the printing head per unit time. To be more specific, in the case where the amount of ink to be ejected per unit time is set large, the dynamic negative pressure on the ink turns to increase; thus, the ink in the printing head is strongly pulled towards the ink tank. On the contrary, when the amount of ink to be ejected per unit time is set small, the dynamic negative pressure on the ink turns to decrease.

Figure 16:
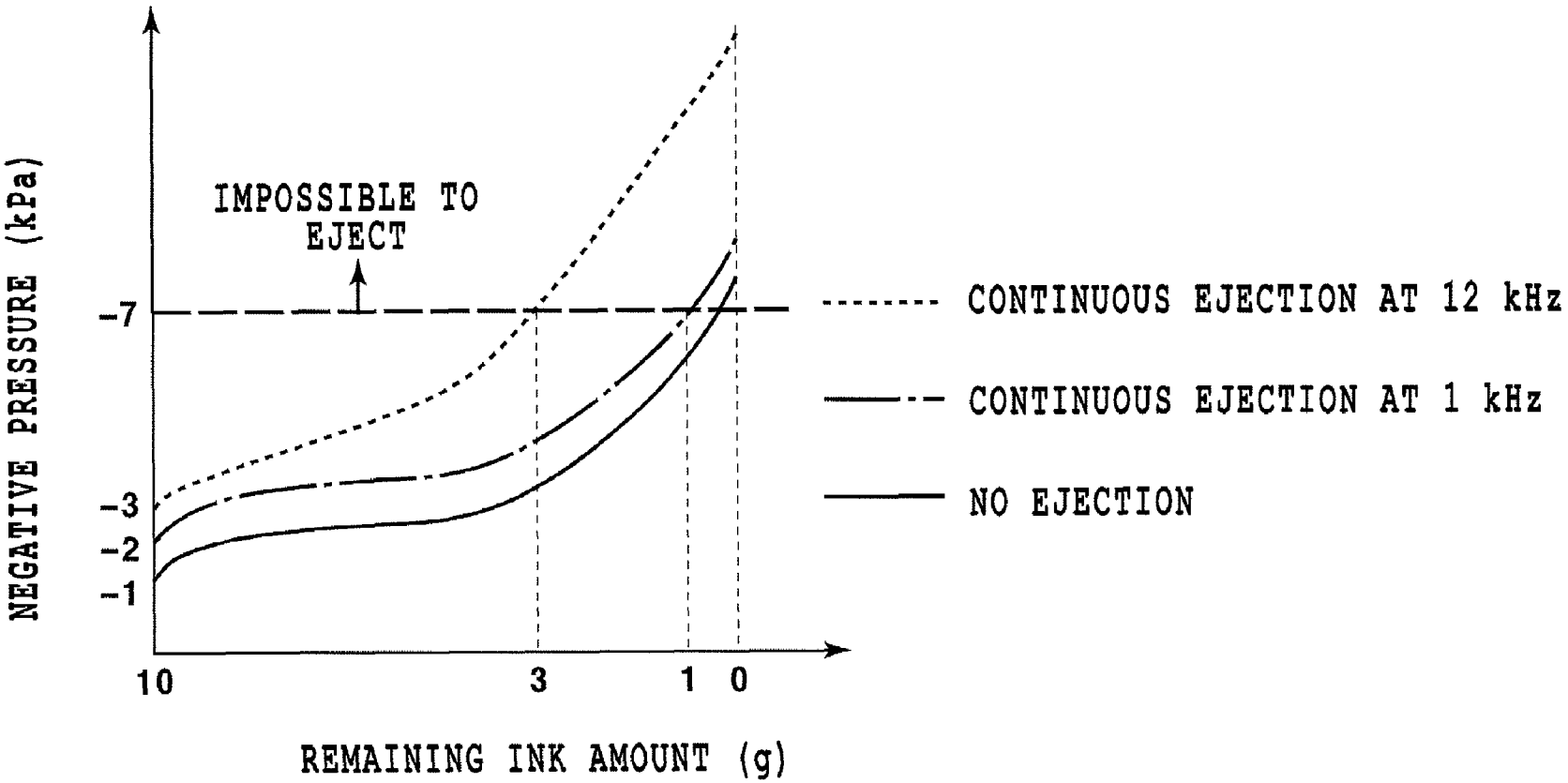
FIG. 16 is an explanatory drawing of the relationship between a remaining ink amount and a negative pressure.

FIG. 16 is an explanatory drawing of the relationship between a remaining ink amount and a negative pressure on ink for various amounts of ink to be ejected per unit time (ejection frequency). In the present embodiment, at the point where the remaining ink amount is 10 g, the initial negative pressure on ink is −1 kPa while no ink is ejected from the printing head. Furthermore, the negative pressure at which it becomes impossible to supply ink to the ejection openings is −7 kPa.

In the case where ink is continuously ejected from the 600 nozzles at a ejection frequency of 12 kHz, the dynamic negative pressure becomes large due to the ink ejection; thus, the negative pressure on the ink becomes −3 kPa even at the point where the remaining ink amount is 10 g. Thereafter, at the point where the remaining ink amount is 3 g, the negative pressure on the ink becomes −7 kPa. Therefore, it is impossible to supply the ink to the ejection openings when the remaining ink amount is below 3 g; thus, ink cannot be ejected from the ejection openings. In the meantime, in the case where ink is continuously ejected from the 600 nozzles at a ejection frequency of 1 kHz, the negative pressure on the ink reaches −2 kPa at the point where the remaining ink amount is 10 g, and −7 kPa at the point where the remaining ink amount is 1 g. Hence, in the case where the ejection frequency is 1 kHz, it is possible to eject ink from the ejection openings until the remaining ink amount goes down to 1 g.

As described above, the amount of ink available for printing at an ejection frequency of 12 kHz is 7 g (=10 g−3 g), while that at an ejection frequency of 1 kHz is 9 g (=10 g−1 g). It should be noted that the relationship between an ejection frequency and an amount of ink available for printing varies in terms of the value, according to other factors such as a flow path of ink, a structure of the ejection openings. However, the present invention is applicable regardless of the value. Furthermore, in the description above, the relationship between a remaining ink amount and a negative pressure on ink has been presented for different ejection frequencies which correspond to an amount of ink ejected per unit time. Likewise, in the case where different numbers of printing passes are employed in a multi-pass printing mode, the same relationship can be observed.

Figure 5:
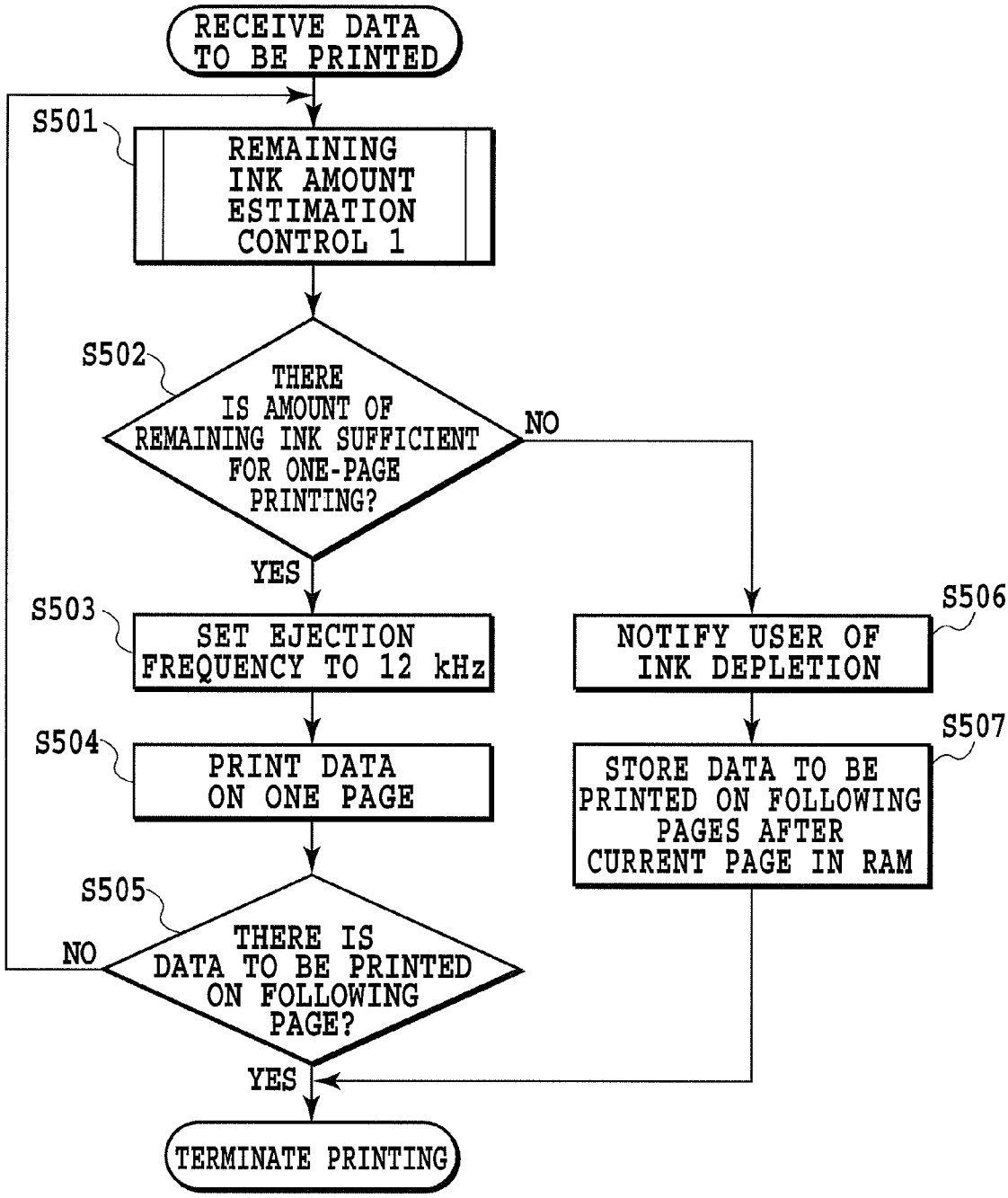
FIG. 5 is a flowchart for describing a printing operation, including those in a method for estimating a remaining ink amount, in the first embodiment of the present invention.

FIG. 5 is a flowchart showing a printing operation, including those in a method for estimating a remaining ink amount, in the present embodiment. Inks supplied to the printing heads 100 and 101 are each controlled in the same manner according to this flowchart. In the following section, a description will be given to the case of a cyan ink supplied to the printing head 101 as a representative example.

Figure 6:
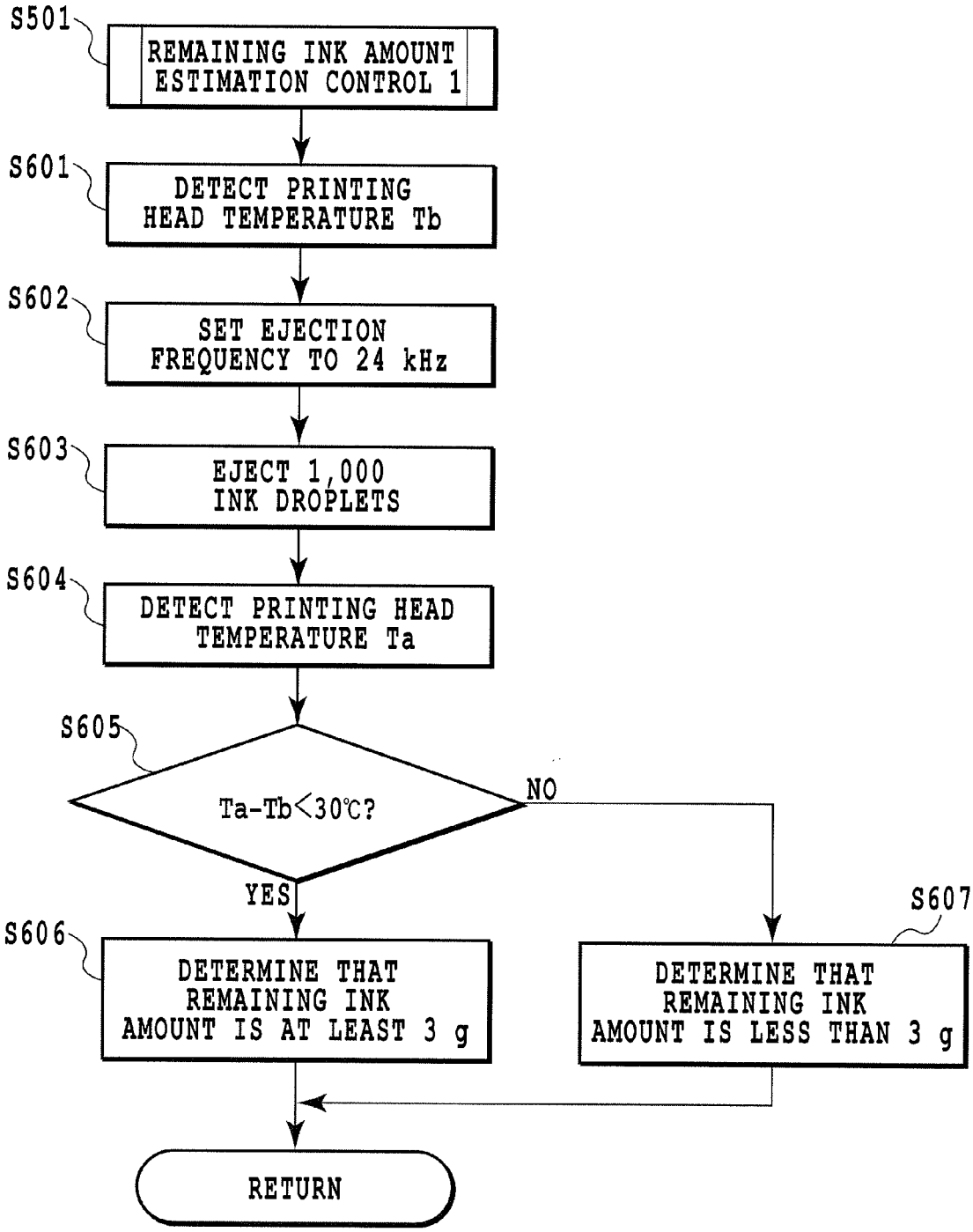
FIG. 6 is a flowchart for describing a remaining ink amount estimation control 1 in FIG. 5.

When the printing apparatus receives data to be printed, a remaining ink amount estimation control 1 is carried out in a step S501. A detailed flow of the remaining ink amount estimation control 1 is shown in FIG. 6. In the remaining ink amount estimation control 1, firstly, a printing head temperature before ink ejection (Tb) is detected on the basis of an output from the diode sensor 208. Next, in a step S602, the ejection frequency of the printing head is set to 24 kHz. Thereafter, in a step S603, 1,000 ink droplets are ejected from the 600 nozzles for cyan ink ejection of the printing head 101 at an ejection frequency of 24 kHz. As in the preliminary ejection, these ink droplets can be ejected into the cap 312. After the completion of the ink ejection, a printing head temperature after ink ejection (Ta) is detected in a step S604.

Figure 7:
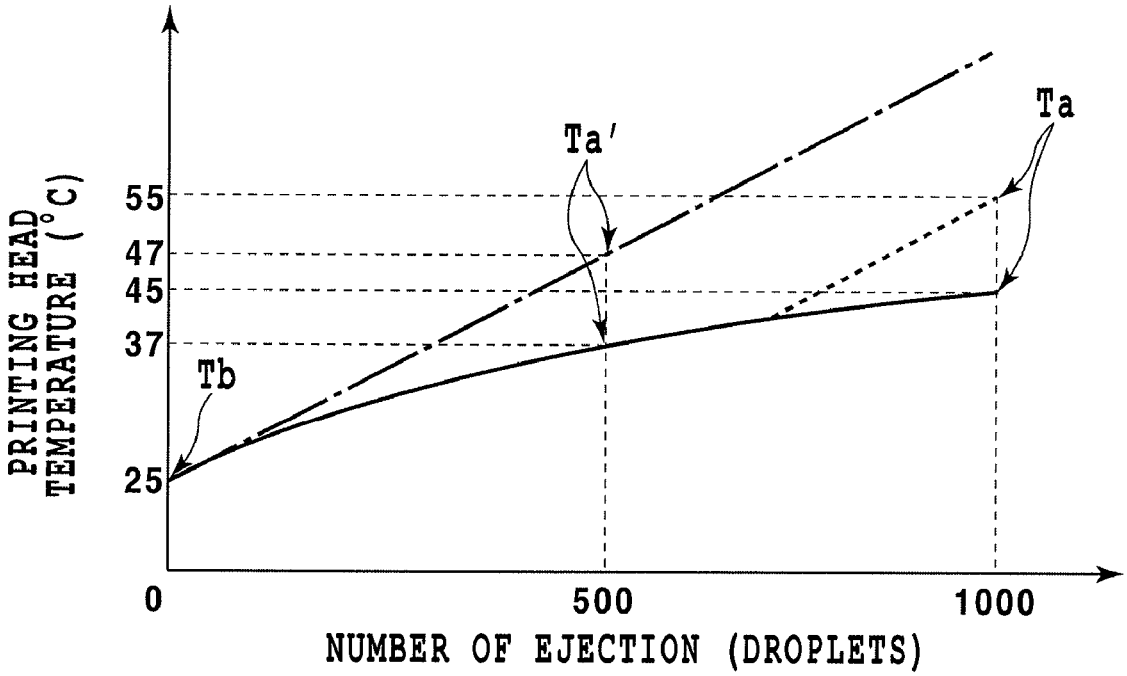
FIG. 7 is an explanatory drawing of an example of the relationship between the temperature of a printing head and a remaining ink amount.

In the following section, a detailed description will be given to the method for estimating a remaining ink amount in the present embodiment. FIG. 7 shows a temporal change of the printing head temperature while ink is being ejected at an ejection frequency of 24 kHz. In FIG. 7, a solid line, a dotted line, and a dashed-dotted line represent a change in the printing head temperature when a remaining ink amount is 10 g, 3 g, and 1 g, respectively. In the case where the ejection of 1,000 ink droplets in the above-described conditions is initiated when the printing head temperature is 25° C., the printing head temperature after ink ejection is 45° C., 55° C., and 60° C. for a remaining ink amount of 10 g, 3 g, and 1 g, respectively. This is because the negative pressure applied to the ink is increased as a remaining ink amount is reduced, and therefore a less amount of ink is supplied to the ejection openings. To be more specific, since a less amount of ink is supplied to the ejection openings, and therefore an amount of ink ejected (an amount of ink actually consumed) is reduced, energy from the heaters tends to accumulate in the printing head. As a result, the printing head temperature rises. For this reason, even if the same numbers of ink droplets are ejected at the same ejection frequency, the printing head temperature after ink ejection tends to rise as a remaining ink amount decreases.

Against such a background, the present embodiment estimates a remaining ink amount by the use of the change in the negative pressure applied to the ink in the printing head or in the ink tank, accompanying a reduction in a remaining ink amount as described above. To be further specific, by the use of the fact that a difference between the printing head temperatures before and after ink ejection becomes larger as a remaining ink amount becomes low, the present embodiment estimates a remaining ink amount.

When the remaining ink amount is at least 3 g, the printing head 101 of the present embodiment is capable of printing any printing patterns on a page of A4-size printing medium without a blur as long as being operated at an ejection frequency of 12 kHz. On the other hand, when the remaining ink amount is less than 3 g, there is a risk of deterioration in image quality due to a blur in a printed image. In other words, 3 g of the remaining ink amount is required to print data on a following page of the printing medium after the estimation of a remaining ink amount without causing deterioration in the image quality. Therefore, the present embodiment determines that the remaining ink amount has been changed from the initial amount of 10 g to 3 g on the basis of a difference between the printing head temperatures before (Tb) and after (Ta) ink ejection.

In this embodiment, in order to determine that a remaining ink amount has been changed from the initial amount of 10 g to 3 g, it is necessary that there is at least a predetermined temperature difference in the printing head temperature after ink ejection (Ta) between the cases where ink is ejected at a predetermined temperature with the remaining ink amount of 10 g and 3 g. In the present embodiment, if there is a 10° C. difference in the printing head temperature (Ta), which also allows for, for example, an error in temperature detection by the diode sensor 208, a remaining ink amount can be determined. It should be noted that, in the case where the remaining ink amount estimation control is carried out before the initiation of printing as described in the present embodiment, it is necessary that there is at least 10° C. difference in the printing head temperature after ink ejection (Ta) at a temperature of 25° C., since the printing head temperature is approximately room temperature (25° C.). In reference to FIG. 7, the printing head temperature after ejection of 1,000 ink droplets (Ta) at room temperature (25° C.) is 45° C. with a remaining ink amount of 10 g, and 55° C. with 3 g. Accordingly, the temperature difference is 10° C. (=55° C.−45° C.). Based on this, the amount of ink to be ejected in the step S603 is set to 1,000 ink droplets in the remaining ink amount estimation control 1 of the present embodiment.

Hence, as shown by the dotted line in FIG. 7, it is possible to determine whether or not there is a remaining ink amount of 3 g or more on the basis of the temperature difference of 30° C. between the printing head temperatures, Tb=25° C. and Ta=55° C., while 1,000 ink droplets are being ejected with a remaining ink amount of 3 g. To be more specific, if the difference between the printing head temperatures (Tb) and (Ta) detected in the steps S601 and S604 is below 30° C., it can be determined that the remaining ink amount is 3 g or more.

In the step S605, on the basis of such a relationship between the printing head temperature and the remaining ink amount, the difference between the printing head temperature after ink ejection (Ta) and the printing head temperature before ink ejection (Tb) is calculated, and then it is determined whether or not the calculation result is below 30° C. If the calculation result is below 30° C., it is determined that the remaining ink amount is at least 3 g (step S606). On the other hand, if the calculation result is 30° C. or above, it is determined that the remaining ink amount is less than 3 g (step S607).

At this point, by referring back to FIG. 5, in a step S502, it is determined whether or not there is a remaining ink amount sufficient for printing data on the following page of printing medium on the basis of the determination result in the preceding step S606 or S607.

To be more specific, in the case where it has been determined that the remaining ink amount is at least 3 g in the step S606, it is determined that there is a sufficient amount of remaining ink for printing data on the following one page, and then the operation proceeds to a step S503. The ejection frequency of the printing head is set to 12 kHz in the step S503, and then printing of data on the following one page is carried out in a step S504. After the printing of data on the page, it is determined whether or not there is data to be printed on the following page in a step S505. If there is data to be printed on the following page, the operation goes back to the step S501 and the above-described series of flow is repeated. If there is no data to be printed on the following page, the printing is terminated.

In the above-described step S502, in the case where it has been determined that the remaining ink amount is less than 3 g, it is determined that there is not a sufficient amount of remaining ink for printing data on the following page, and then the operation proceeds to a step S506. In the step S506, the host apparatus is notified that ink has been depleted, and the user is notified as well by use of a display. Thereafter, in the next step S507, data yet to be printed on following pages are stored in the RAM, and then the printing is terminated.

Figure 8:
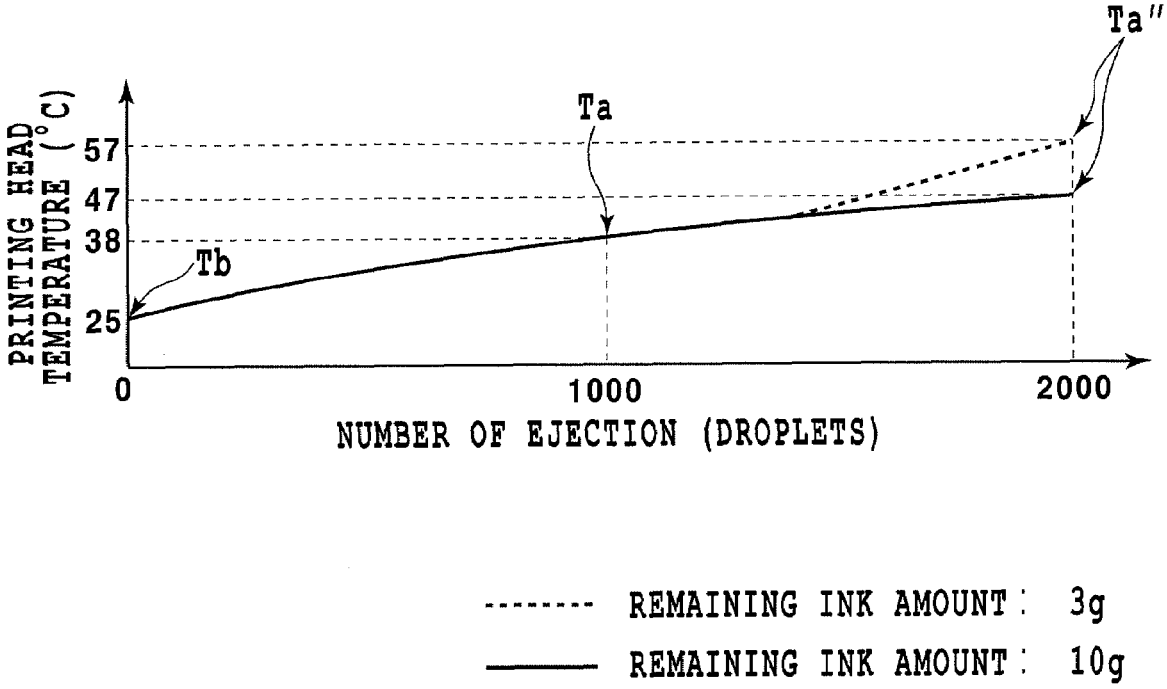
FIG. 8 is an explanatory drawing of another example of the relationship between the temperature of the printing head and a remaining ink amount.

FIG. 8 is an explanatory drawing of a comparative example to the present embodiment. In a remaining ink amount estimation control in this comparative example, after the ejection frequency of the printing head is set to 12 kHz, not 24 kHz, in the step S602 in FIG. 6, 1,000 ink droplets are ejected in the next step S603. FIG. 8 shows a temporal change in the printing head temperature while ink is being ejected as described above.

In this comparative example, the printing head temperature after ejection of 1,000 ink droplets (Ta) is the same temperature of 38° C. for both cases where the remaining ink amount is 10 g and 3 g; thus, there is no difference in the printing head temperature between these cases. Accordingly, it cannot be determined whether a remaining ink amount is 10 g or 3 g on the basis of a difference in the printing head temperature. To be more specific, it cannot be determined, as in the present embodiment described above, whether or not there is a remaining ink amount sufficient for printing data on the following page of printing medium. If a temperature difference of 10° C. between the cases where the remaining ink amount is 10 g and 3 g is to be achieved as in the present embodiment, it would be necessary that the amount of ink to be ejected be set to 2,000 droplets at a ejection frequency of 12 kHz, and that the printing head temperature after ejection of 2,000 ink droplets (Ta") be used as an indicator.

Therefore, as clearly demonstrated in the comparison with this comparative example, the present embodiment allows determination of remaining ink amount to be performed with less amount of ink consumed by setting the ejection frequency during the estimation of a remaining ink amount to 24 kHz, which is higher than the ejection frequency during printing of 12 kHz.

As described above, a remaining ink amount is estimated by using a higher ejection frequency during the estimation than during regular printing in the present embodiment. By having this configuration, it is possible to estimate a remaining ink amount sufficient for printing data on the following page even with a consumption of less amount of ink.

Furthermore, in the present embodiment, it is determined whether or not there is a remaining ink amount sufficient for printing on a one-page basis. Determination of a remaining ink amount, however, is not limited to this manner, and a remaining ink amount may be determined after every few scans or after printing data on a few pages.

Second Embodiment

In the first embodiment described above, it is possible to restrain the amount of ink consumed during estimation of a remaining ink amount by setting the ejection frequency during the estimation higher than that during printing. However, in the case where a new printing head containing a sufficient amount of remaining ink, that is, a printing head having its ink tank fully filled with ink, is provided, if estimation of a remaining ink amount involving ink ejection is performed every time data to be printed is received, a total amount of ink consumed at the end would be large. In addition, regarding the printing conditions during printing after the estimation of a remaining ink amount, no consideration is taken because the focus is on restraining the amount of ink consumed during the estimation of a remaining ink amount. Hence, based on these points, a second embodiment of the present invention aims to further restrain an amount of ink consumed during the estimation of a remaining ink amount.

Figure 9:
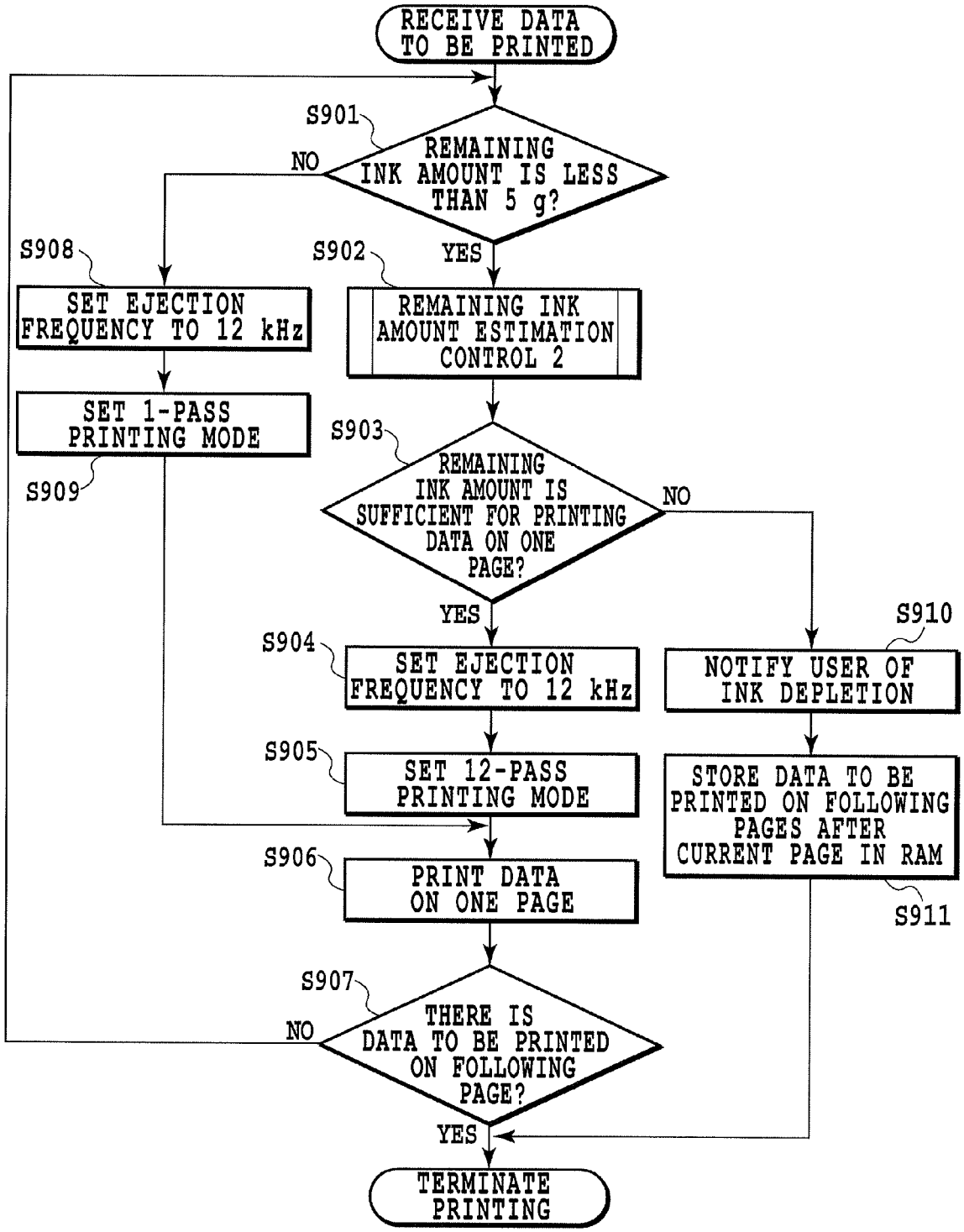
FIG. 9 is a flowchart for describing a printing operation, including those in a method for estimating a remaining ink amount, in a second embodiment of the present invention.

FIG. 9 is a flowchart for describing a printing operation, including those in a method for estimating a remaining ink amount, in the second embodiment. Inks supplied to the printing heads 100 and 101 are controlled in the same manner according to this flowchart. In the following section, a description will be given to the case of a cyan ink supplied to the printing head 101 as a representative example.

When the printing apparatus receives data to be printed, it is determined whether or not a remaining ink amount is sufficient (in this embodiment, whether or not the remaining ink amount is at least 5 g) in a step S901. This determination of a remaining ink amount does not require very high estimation accuracy. Therefore, in the present embodiment, it is determined whether or not the remaining ink amount is less than 5 g by calculating the amount of ink consumed on the basis of the number of ink ejection up to this point, and then by subtracting the amount of consumption from the initial amount of ink in the ink tank thereby to obtain the remaining ink amount. If the remaining ink amount is at least 5 g, the ejection frequency is set to 12 kHz in a step S908, and then the printing mode is set to the one-pass printing mode in a step S909. Thereafter, printing data on one page is initiated in a step S906. If the remaining ink amount is less than 5 g, a remaining ink amount estimation control 2 is carried out in a step S902. Therefore, in the above-described step S901, the remaining ink amount is estimated (second estimation means) by a method different from the step S902.

Figure 10:
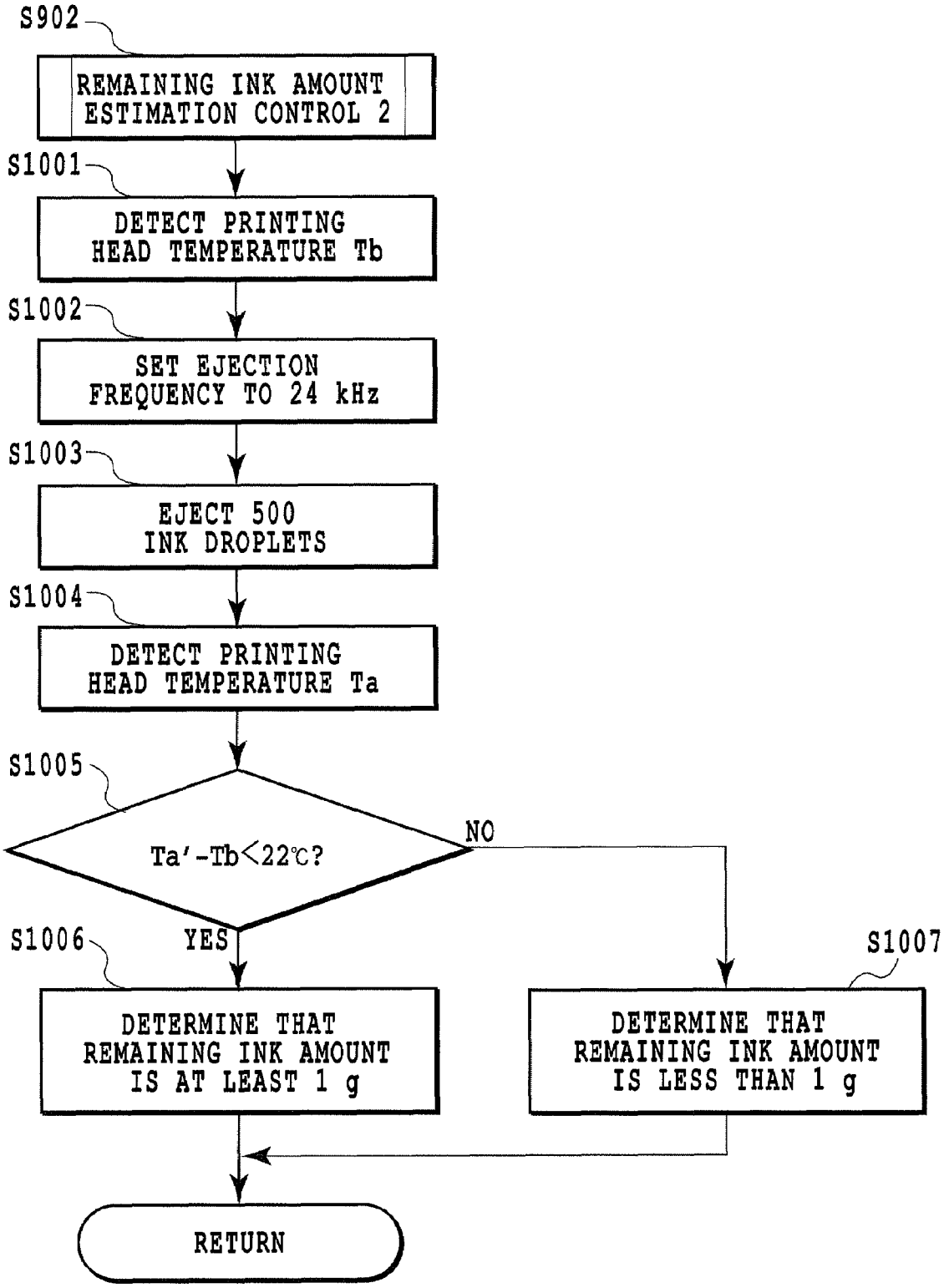
FIG. 10 is a flowchart for describing a remaining ink amount estimation control 2 in FIG. 9.

FIG. 10 shows the detail of a flow of the remaining ink amount estimation control 2.

Steps S1001 to S1007 in the remaining ink amount estimation control 2 correspond to the steps S601 to S607 in the remaining ink amount estimation control 1 in the first embodiment described above. However, these steps in the remaining ink amount estimation control 2 are different from the remaining ink amount estimation control 1 in the following three points. To be more specific, as the first point of difference, while the amount of ink to be ejected is set to 1,000 droplets in the step S603 in the remaining ink amount estimation control 1, that is set to 500 droplets in the step S1003. As the second point of difference, while it is determined whether or not the difference of the printing head temperatures (Ta−Tb) is below 30° C. in the step S605 in the remaining ink amount estimation control 1, it is determined whether or not the difference of the printing head temperatures (Ta'−Tb) is below 22° C. in the step S1005. As the third point of difference, while it is determined whether or not the remaining ink amount is at least 3 g in the steps S606 and S607 in the remaining ink amount estimation control 1, it is determined whether or not the remaining ink amount is at least 1 g in the steps S1006 and S1007.

In the case where the remaining ink amount is at least 1 g, the printing head 101 in the present embodiment is capable of printing any printing patterns for an A4-size page without a blur as long as performing in the 12-pass printing mode while being driven at an ejection frequency of 12 kHz. This is because, as having been described by referring to FIG. 16, the relationship between the remaining ink amount and the ink negative pressure is changed by varying the number of printing passes in a multi-pass printing mode, which is equivalent to the amount of ink to be ejected per unit time. Note that the 12-pass printing mode is a printing method in which a predetermined area of an image is completed with 12 printing scans of the printing head. Under such printing conditions, if the remaining ink amount in the printing head 101 is less than 1 g, there is a risk of deteriorating the image quality. For this reason, in the remaining ink amount estimation control 2, it is determined whether or not a remaining ink amount has been changed from the initial amount of 10 g to 1 g on the basis of a temperature difference of the printing head before and after ink ejection.

As described in the first embodiment, in order to determine that a remaining ink amount has been changed from the initial amount of 10 g to 1 g, it is necessary that there is at least a predetermined temperature difference in the printing head temperature after ink ejection (Ta) between the cases where the remaining ink amount is 10 g and 1 g. In the present embodiment, it is necessary to have a temperature difference of at least 10° C., which also includes, for example, an error in temperature detection by the diode sensor 208, in the printing head temperature after ink ejection (Ta) between the cases where the remaining ink amount is 10 g and 1 g. In the present case, as shown in FIG. 7, the printing head temperature (Ta') after ejection of 500 ink droplets is 37° C. with a remaining ink amount of 10 g, and 47° C. with 1 g. Accordingly, the temperature difference is 10° C. (=47° C.−37° C.). Based on this, the amount of ink ejected in the step S1003 is set to 500 ink droplets in the remaining ink amount estimation control 2 of the present embodiment. It should be noted that this number is smaller than the number of ink droplets set to be ejected in the first embodiment. This is because a less amount of ink is supplied to the ejection openings with a remaining ink amount of less than 3 g, and therefore a temperature difference of a predetermined level or above can be achieved even if the number of ink droplets to be ejected is set to be lower.

Hence, as indicated by the dashed-dotted line in FIG. 7, it is possible to determine whether or not there is a remaining ink amount of 1 g or more on the basis of the temperature difference of 22° C. between the printing head temperatures, Tb=25° C. and Ta'=47° C. It should be noted that, other operations in the remaining ink amount estimation control 2 are the same as those in the remaining ink amount estimation control 1; thus, the explanation is omitted.

At this point, by referring back to FIG. 9, in a step S903, it is determined whether or not there is a remaining ink amount sufficient for printing data on the following page of printing medium on the basis of the determination result in the preceding step S1006 or S1007.

To be more specific, in the case where it has been determined that the remaining ink amount is at least 1 g in the preceding step S1006, it is determined that there is a sufficient amount of remaining ink for printing data on the following one page, and then the operation proceeds to a step S904. The ejection frequency of the printing head is set to 12 kHz in the step S904, the printing mode is set to the 12-pass printing mode in a step S905, and then the printing on the following one page is carried out in a step S906. After the printing data on the page, it is determined whether or not there is data to be printed on the following page in a step S907. If there is data to be printed on the following page, the operation goes back to the step S901, and the above-described series of flow is repeated. If there is no data to be printed on the following page, the printing is terminated.

In the above-described step S1007, in the case where it has been determined that the remaining ink amount is less than 1 g, it is determined that there is not a sufficient amount of remaining ink for printing data on the following page, and then the operation proceeds to a step S910. In the step S910, the host apparatus is notified that ink has been depleted, and the user is notified as well by use of a display. Thereafter, in the next step S911, data yet to be printed on following pages are stored in the RAM, and then the printing is terminated.

In the present embodiment, in the case where it can be determined that there is a sufficient amount of remaining ink, in other words, until the remaining ink amount reaches less than 5 g, no remaining ink amount estimation control involving ink ejection is carried out. Therefore, the consumption of ink can be restrained. Meanwhile, in the case where the remaining ink amount estimation control involving ink ejection is carried out after the remaining ink amount reaches less than 5 g, it is configured that the printing mode, as a printing condition during the printing after the estimation of a remaining ink amount, is changed to the 12-pass printing mode. In such a configuration, it is possible to carry out printing until the remaining ink amount reaches 1 g, by wasting less ink in the ink tank. Furthermore, with the remaining ink amount estimation control 2 configured to determine whether or not a remaining ink amount is at least 1 g, the set amount of ink to be ejected can be reduced from 1,000 ink droplets in the first embodiment to 500 ink droplets. To be more specific, by increasing the number of printing passes after the estimation of a remaining ink amount involving ink ejection is performed, it is possible to use the ink in the ink tank until the amount of the remaining ink becomes further smaller, and to estimate a remaining ink amount with high accuracy even when an amount of ink to be ejected is set to be low.

In the present embodiment, the reference value is set to 5 g, and an ink amount is estimated by ejecting ink when the remaining ink amount is less than the reference value. In such a case, the method for estimating a remaining ink amount without ejecting ink until the remaining ink amount reaches the reference value is not limited to an estimation method based on the number of times that ink has been ejected. Various methods may also be employed, such as a remaining ink amount estimation method in which optical information is obtained with a prism provided in an ink tank.

Third Embodiment

In the first and second embodiments described above, it is configured that, when a remaining ink amount is to be estimated, it is determined whether or not there is a predetermined remaining ink amount, regardless of an amount of data to be printed on the following page, the size of a printing medium, and the like. For this reason, it is determined that there is no remaining ink unless there is a remaining ink amount which allows printing of any printing patterns on a page of A4-size printing medium without a blur, in other words, unless there is at least 1 g of remaining ink amount, as long as the printing head is driven at an ejection frequency of 12 kHz. It should be noted that the A4-size is the maximum size of printable printing medium in the printing apparatus of the present embodiment.

However, in the case where the data to be printed on the following page is small or where the size of a printing medium is small, the amount of ink required for printing is small; thus, the reference level for determining whether or not there is a remaining ink amount sufficient for printing data on the following page may be lower.

Furthermore, the reference level for determination of a remaining ink amount also varies according to the amount of ink to be ejected per unit time (for example, the number of printing passes) during printing data on the following page. In other words, if the amount of ink to be ejected per unit time is small, the dynamic negative pressure on the ink turns to decrease; thus, the above-mentioned reference level for determination of a remaining ink amount may be lower.

In such a case where the reference level for determination of a remaining ink amount is decreased, as has been described in the second embodiment, it is possible to set a smaller amount of ink to be ejected in the remaining ink amount estimation control. Based on these points, a third embodiment aims to restrain the consumption of ink during the estimation of a remaining ink amount by estimating a remaining ink amount according to the amount of ink required for printing data on the following page and the amount of ink to be ejected per unit time.

Figure 11:
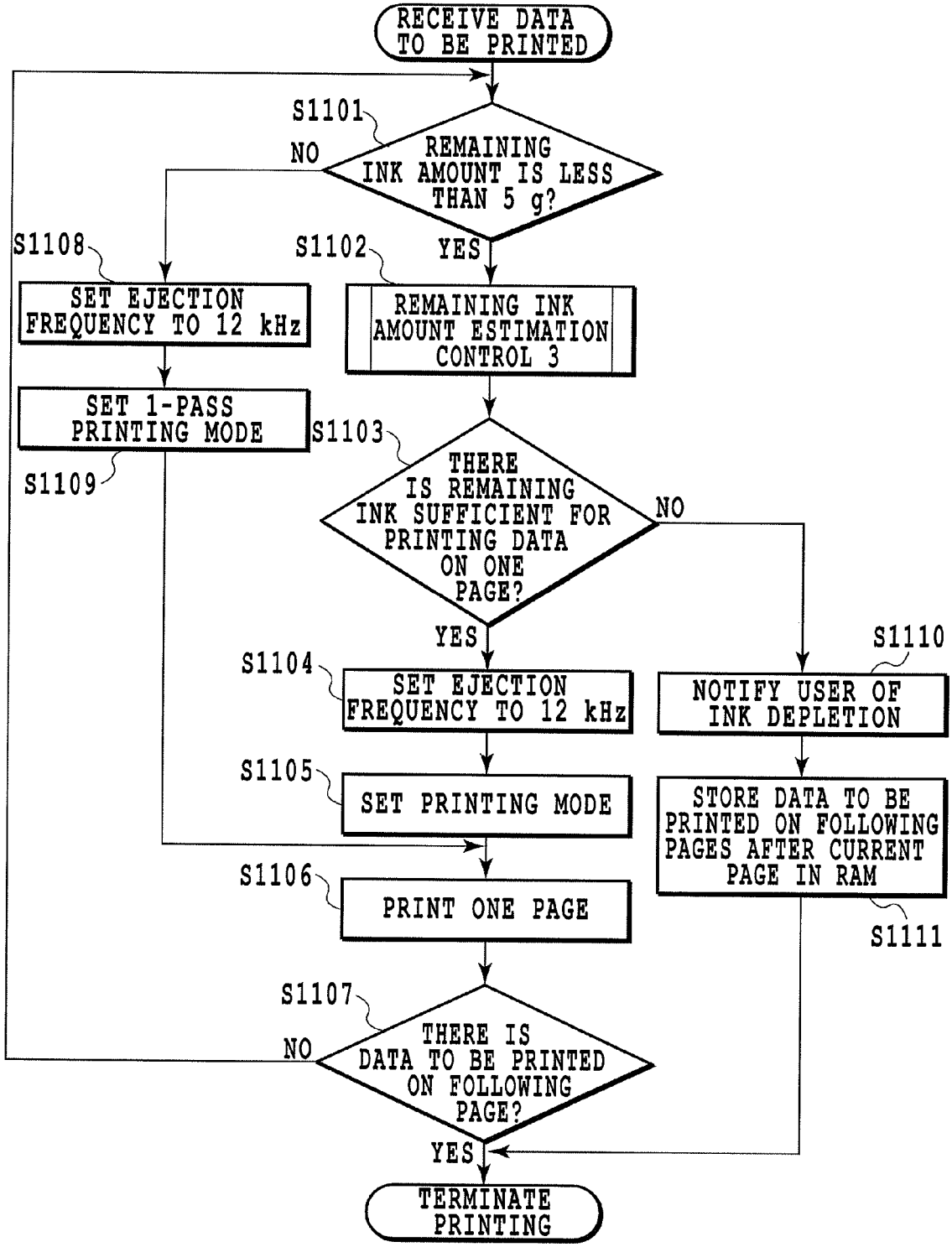
FIG. 11 is a flowchart for describing a printing operation, including those in a method for estimating a remaining ink amount, in a third embodiment of the present invention.

FIG. 11 is a flowchart for describing a printing operation, including those in a method for estimating a remaining ink amount, in the third embodiment. Inks supplied to the printing heads 100 and 101 are controlled in the same manner according to this flowchart. In the following section, a description will be given to the case of a cyan ink supplied to the printing head 101 as a representative example.

Steps S1101 to S1111 in FIG. 11 correspond to the steps S901 to S911 in FIG. 9 in the second embodiment described above. However, these steps in the flowchart in FIG. 11 are different from the flowchart in FIG. 9 in the following two points. To be more specific, as the first point of difference, the remaining ink amount estimation control 2 in the step S902 in FIG. 9 is replaced by a remaining ink amount estimation control 3 in the step S1102. As the second point of difference, the process to set a 12-pass printing mode in the step S905 in FIG. 9 is replaced by a process to set a printing mode in the step S1105. In the step S1105, as will be described later, a designated printing mode is to be set. In the present case, printing modes available for the setting include a one-pass printing mode for printing data on an A4-size paper and a 12-pass printing mode for printing data on a name card-size paper.

Figure 12:
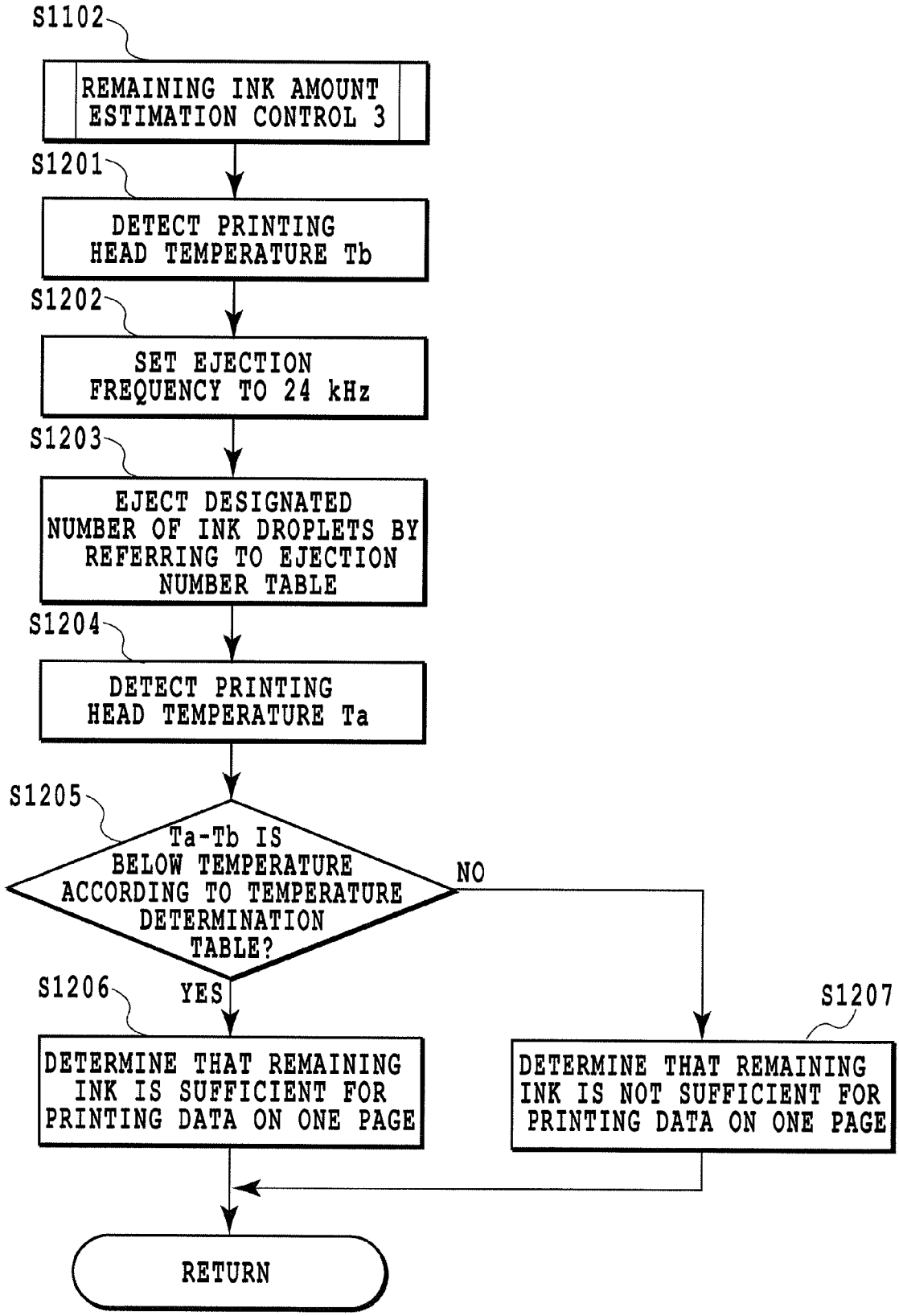
FIG. 12 is a flowchart for describing a remaining ink amount estimation control 3 in FIG. 11.

FIG. 12 shows the detail of the flow of the remaining ink amount estimation control 3.

Firstly, the temperature of the printing head before ink ejection (Tb) is detected on the basis of an output from the diode sensor 208 in a step S1201. Then, the ejection frequency of the printing head is set to 24 kHz in a step S1202. Thereafter, in a step S1203, on the basis of the number of printing passes and the size of printing medium for printing data on the following page, by referring to a table shown in FIG. 14, the amount of ink designated in the table is ejected. The table is for the number of ink droplets to be ejected, and located inside the ROM 310. The detail thereof will be described later.

There are some cases where the data to be printed on the following page is small or where the size of a printing medium for the printing is small. In such cases, since the amount of ink required for printing is small, the reference level for determination whether or not there is a remaining ink amount sufficient to reliably carry out printing of data on the following page without a blur may be lower. Moreover, in the case where the amount of ink to be ejected per unit time is set small for printing of data on the following page also, the reference level for determination of a remaining ink amount may be lower, since the dynamic negative pressure on the ink turns to decrease.

FIG. 13 is an explanatory drawing of the relationship among the number of printing passes, the size of printing medium, and a remaining ink amount required for reliably printing data on the following page.

As shown in this drawing, in the case where printing is carried out in the one-pass printing mode on an A4-size paper, there is a risk of ink being blurred in the middle of the printing operation on the same page, unless the remaining ink amount is at least 3 g. Meanwhile, in the case where printing is carried out in the 12-pass printing mode on an A4-size paper, the printing can be reliably carried out on the same page with no blur if the remaining ink amount is at least 1 g.

It should be noted that, as has been also described in the second embodiment, in the case where a remaining ink amount that is used as a reference for determination whether or not there is a remaining ink amount sufficient for reliably printing data on a following page (hereafter also referred to as "reference remaining ink amount for determination") is set low, it is possible to restrain the set amount of the ink to be ejected for the estimation of a remaining ink amount.

In the present embodiment, in order to determine that a remaining ink amount has reached to a reference remaining ink amount for determination, it is also necessary that there is a difference of 10° C. between the printing head temperatures (Ta) for the initial remaining ink amount (10 g) and the reference remaining ink amount for determination. In order to obtain a 10° C. difference in the printing head temperature (Ta), it is required to eject 1,000 ink droplets as in the first embodiment described above in the case where the reference remaining ink amount for determination is set to 3 g. Meanwhile, in the case where the reference remaining ink amount for determination is set to 1 g, it is required to eject 500 ink droplets as in the second embodiment described above.

FIG. 13 shows a reference remaining ink amount for determination for each condition of the number of printing passes and the size of the printing medium. FIG. 14 is an explanatory drawing of the table of the number of ink droplets to be ejected, which is located within the ROM 301.

The ejection number table is referenced, as described above, when the remaining ink amount estimation control is carried out. In the table, a reference remaining ink amount for determination correlates with each condition of the number of printing passes and the size of the printing medium. For example, in the case where printing of data on the following page is carried out on an A4-size paper in the one-pass printing mode, 3 g of remaining ink amount is required for the printing on the page (see, FIG. 13). Then, in order to determine whether or not there is 3 g of remaining ink amount, it is necessary to eject 1,000 ink droplets (see, FIG. 14).

In this section, as an example of printing data on the following page, the case of a mode for printing data on a name card-size paper in the 12-pass printing mode is described. In this case, the corresponding number of ink droplets to be ejected of 440 is selected by referring to the ejection number table in FIG. 14 in a step S1203 in FIG. 12, and then 440 ink droplets are ejected. After the ejection of the 440 ink droplets, a printing head temperature after the ink ejection (Ta) is detected in a step S1204. Next, in a step S1205, the difference (Ta−Tb) between the printing head temperature after the ink ejection (Ta) and a printing head temperature before the ink ejection (Tb) is calculated. The calculation result and a value (determination temperature) selected from the temperature determination table in FIG. 15, which will be described late, are compared. Then, if the temperature difference (Ta−Tb) is smaller than the determination temperature selected from the temperature determination table, it is determined in a step S1206 that there is a remaining ink sufficient for printing of data on the following page. On the other hand, if the temperature difference (Ta−Tb) is larger than the determination temperature from the temperature determination table, it is determined in a step S1207 that there is no remaining ink sufficient for printing of data on the following page.

The temperature determination table in FIG. 15 correlates the number of ink droplets ejected in the step S1203 with a value (determination temperature) which is to be compared to an actual difference in the printing head temperature for the estimation of a remaining ink amount. For example, in the case where a remaining ink amount is estimated by ejecting 1,000 ink droplets in the step S1203, the determination temperature selected according to the temperature determination table is 30° C. Meanwhile, in the case where 500 ink droplets are ejected for the estimation of a remaining ink amount, the selected determination temperature is 22° C. In this manner, the present case utilizes a table, as shown in FIG. 15, for temperature determination. However, the temperature difference for estimation of a remaining ink amount according to the number of ink droplets ejected may also be acquired by calculation. In such a case, an equivalent effect can also be obtained.

In the present case, since 440 ink droplets have been ejected in the step S1203, the corresponding determination temperature of 21° C. is selected from the temperature determination table in FIG. 15. Then, in the step S1205, it is determined whether or not the temperature difference of the printing head (Ta−Tb) is less than 21° C. If the temperature difference (Ta−Tb) is less than 21° C., it is determined in the step S1206 that the remaining ink amount is at least 0.5 g, and, therefore, there is a remaining ink amount sufficient for printing data on the following page. On the other hand, if the temperature difference (Ta−Tb) is 21° C. or above, it is determined in the step S1207 that the remaining ink amount is less than 0.5 g, and therefore, there is not a sufficient remaining ink amount for printing data on the following page.

At this point, by referring back to FIG. 11, the determination result in the previous step S1206 or S1207 is examined in the step S1103. In the case where it has been determined that there is a remaining ink amount sufficient for printing data on one page in the previous S1206, the ejection frequency of the printing head is set to 12 kHz in the step S1104. Thereafter, the printing mode is set to the 12-pass printing mode with a name card-size printing medium in the step S1105, and then printing is carried out on one page in the step S1106. After the printing, it is determined whether or not there is data to be printed on the following page in the step 1107. If there is data to be printed on the following page, the operation goes back to the step S1101, and the above-described series of flow is repeated. On the other hand, if there is no data to be printed on the following page, the printing is terminated.

Meanwhile, in the case where it has been determined that there is not sufficient remaining ink for printing data on one page in the previous step S1207, the host apparatus is notified that ink has been depleted, and the user is notified as well by use of a display in the step S1110. Thereafter, in the step S1111, data yet to be printed on following pages are stored in the RAM, and then the printing is terminated.

In the present embodiment, in the case where printing is performed on a small-size printing medium, such as the name card, in a printing mode, such as the 12-pass printing mode, in which an amount of ink ejected per unit time is small, it is possible to restrain the number of ink droplets to be ejected required for the estimation of a remaining ink amount to 440. It should be noted, however, that it is necessary to eject 1,000 ink droplets for the estimation of a remaining ink amount in the case where the printing is performed on an A4-size printing medium in the one-pass printing mode.

As described above, in the present embodiment, a remaining ink amount has been estimated by changing the set amount of ink to be ejected and the determination temperature on the basis of the number of printing passes and the size of the printing medium for printing data on the following page. By having this configuration, the present embodiment makes it possible to restrain the consumption of ink during the estimation of a remaining ink amount.

The method for estimating a remaining ink amount of the present embodiment is configured to acquire a reference remaining ink amount for determination on the basis of the number of printing passes and the size of a printing medium. However, the configuration is not limited to this in the case where a remaining ink amount is estimated on the basis of the amount of ink to be used and the amount of ink to be ejected per unit time during printing of data on the following page. For example, on the basis of the amount of data to be printed and the maximum amount of ink ejected, estimation of a remaining ink amount may be performed by modifying the reference remaining ink amount for determination in accordance with the amount of ink to be used for the following page.

Furthermore, in the present embodiment, it is configured that a remaining ink amount estimation suitable for an amount of ink required for printing data on a following page and an amount of ink to be ejected per unit time is performed based on the number of printing passes and the size of a printing medium. However, such an estimation of a remaining ink amount can also be conducted on the basis of, in addition to the number of printing passes and the size of the printing medium, various data involved in a following printing operation in a predetermined unit. In other words, the estimation can be performed based on the maximum amount of ink ejected, the number of printing passes, the number of ejection openings used in ink ejection, and the degree of thinning of data to be printed, the size of a printing medium, the amount of data to be printed, and the like. In addition to adopting one of these information pieces, more than one of these information pieces may be used in combination.

Furthermore, in the present embodiment, as for the timing of acquiring the number of printing passes and the size of a printing medium for printing data on the following page, it may be anytime before referring to the ejection number table in the step S1203, and is not limited.

Fourth Embodiment

In the first to third embodiments, in the case where ink ejection is initiated with a printing head temperature of 25° C., it is necessary that there is a temperature difference of at least 10° C., which also allows for, for example, an error in temperature detection by a diode sensor, between the printing head temperatures (Ta) for the initial remaining ink amount (10 g) and for a reference remaining ink amount for determination. However, this temperature difference of 10° C. is an overestimated value to allow for a variation in temperature rise property among individual printing heads and that in temperature reading accuracy among individual diode sensors.

Therefore, in the present embodiment, specific temperature characteristics of a printing head are measured in a state where it is certainly determined that there is a remaining ink. By this measurement, it is possible to determine a remaining ink amount even when a temperature difference between the printing head temperatures (Ta) is small. Thus, an amount of ink consumed in a remaining ink estimation control can be reduced.

Figure 17A:
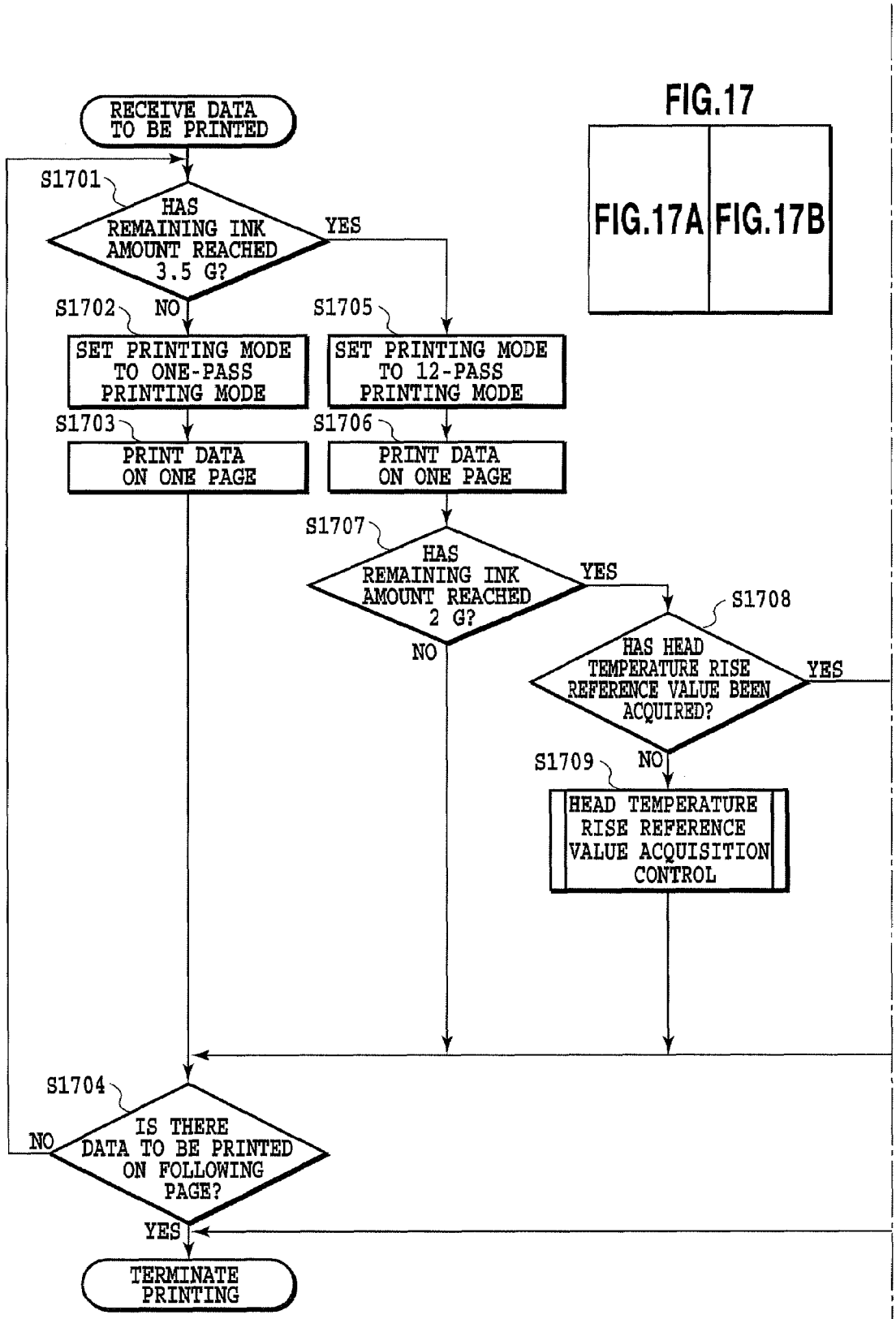
FIG. 17A and FIG. 17B are flowcharts for describing a printing operation and a remaining ink amount estimation operation in a fourth embodiment of the present invention.
Figure 17B:
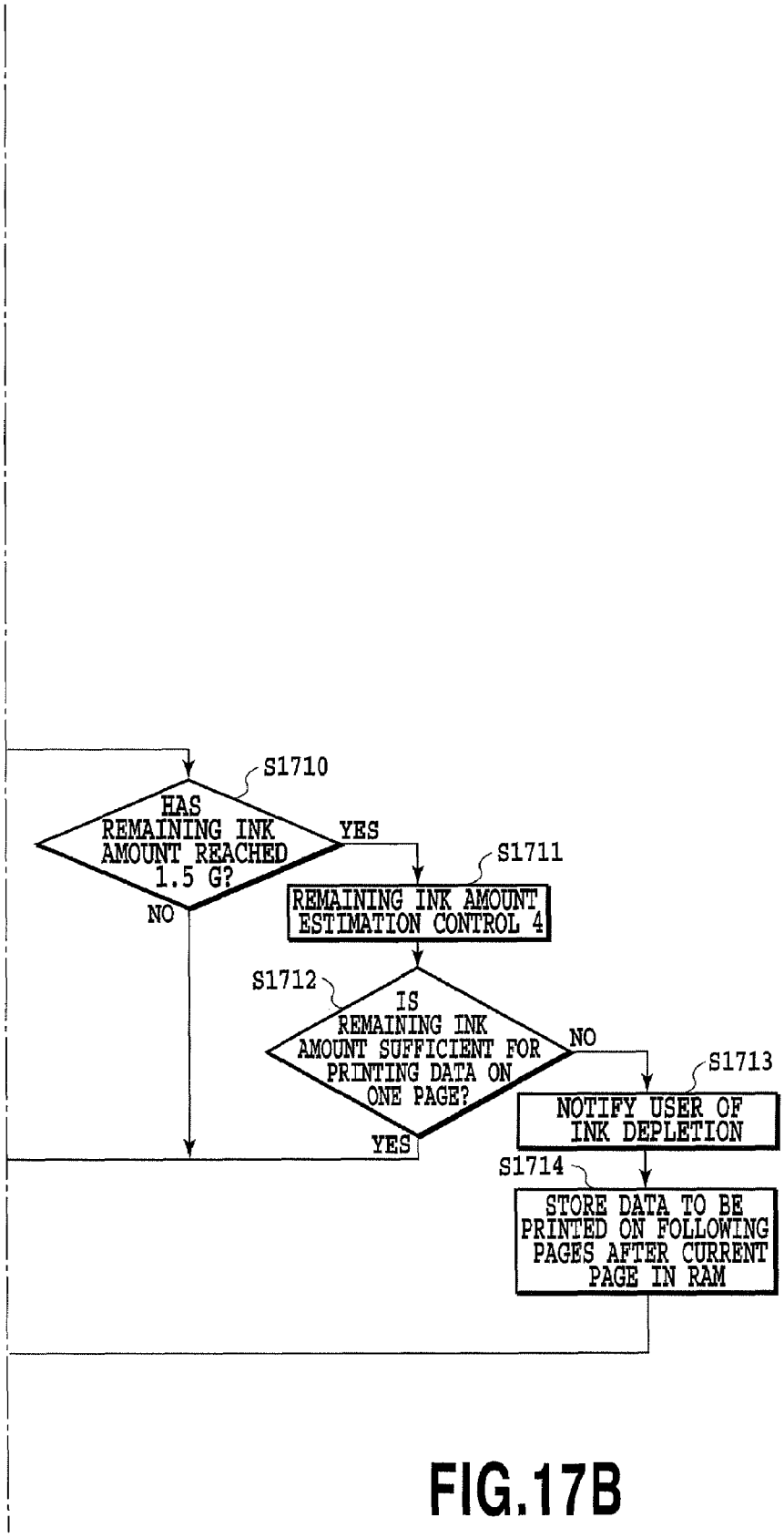

FIG. 17 is a flowchart showing the outline of a printing operation, including a remaining ink amount estimation method, in the fourth embodiment. In this flowchart, the printing heads 100 and 101 are also controlled in the same manner; therefore, a description will be given of the case of a cyan ink supplied to the printing head 101 as a representative example.

When the printing apparatus of the present embodiment receives data to be printed, it is determined whether or not a remaining ink amount is less than 3.5 g in a step S1701. In this determination which does not require a very high accuracy, a consumption of ink is calculated (hereafter referred to as dot-count control) according to a theoretical value of an amount of ink to be ejected and the number of times of ink ejection conducted to determine whether or not a remaining ink amount is less than 3.5 g. This value, 3.5 g, is obtained by adding a maximum amount of ink required for the next printing and an amount of ink required for recovery control in the next printing, to a minimum amount required to determine that there is a sufficient amount of ink to print data on an A4-size page in the one-pass printing mode even allowing for a maximum tolerance of a theoretical value for an amount of ink having been consumed. The theoretical value for an amount of ink having been consumed is equivalent to a theoretical value of an amount of ink ejected from the nozzles and an amount of ink required for recovery control.

In the case where the remaining ink amount is at least 3.5 g in the step S1701, the printing mode is set to the one-pass printing mode in a step S1702, and then printing of the following one page is carried out in a step S1703. After printing data on the page, it is determined whether or not there is data to be printed on the following page in a step S1704. If there is no data to be printed on the following page, the printing is terminated. If there is data to be printed on the following page, the operation goes back to the step S1701.

On the other hand, in the case where a remaining ink amount is determined to be less than 3.5 g in the step S1701, the printing mode is set to the 12-pass mode in a step S1705, and printing of the following one page is carried out in a step S1706. The reason for setting the numbers of printing passes to 12 passes has already been explained in the second embodiment. After printing data on the one page, it is determined whether or not the remaining ink amount is less than 2 g in a step S1707. This value, 2 g, is obtained by adding a maximum amount of ink required for the next printing, an amount of ink required for recovery control in the next printing, and an amount of ink required for head temperature rise reference value acquisition control, which will be described later, to a minimum amount required to determine that there is a sufficient amount of ink to print data on an A4-size page in the 12-pass printing mode even allowing for a maximum tolerance of a theoretical value for the amount of ink having been consumed.

In the case where the remaining ink amount has been determined to be at least 2 g in the step S1707, the operation proceeds to the step S1704, and it is determined whether or not there is data to be printed on the following page. On the other hand, in the case where the remaining ink amount has been determined to be less than 2 g, it is determined whether or not a head temperature rise reference value has already been acquired in a step S1708. At this point, if a head temperature rise reference value has not been acquired, the operation proceeds to a step S1709 to carry out the head temperature rise reference value acquisition control for acquiring a head temperature rise reference value.

Figure 18:
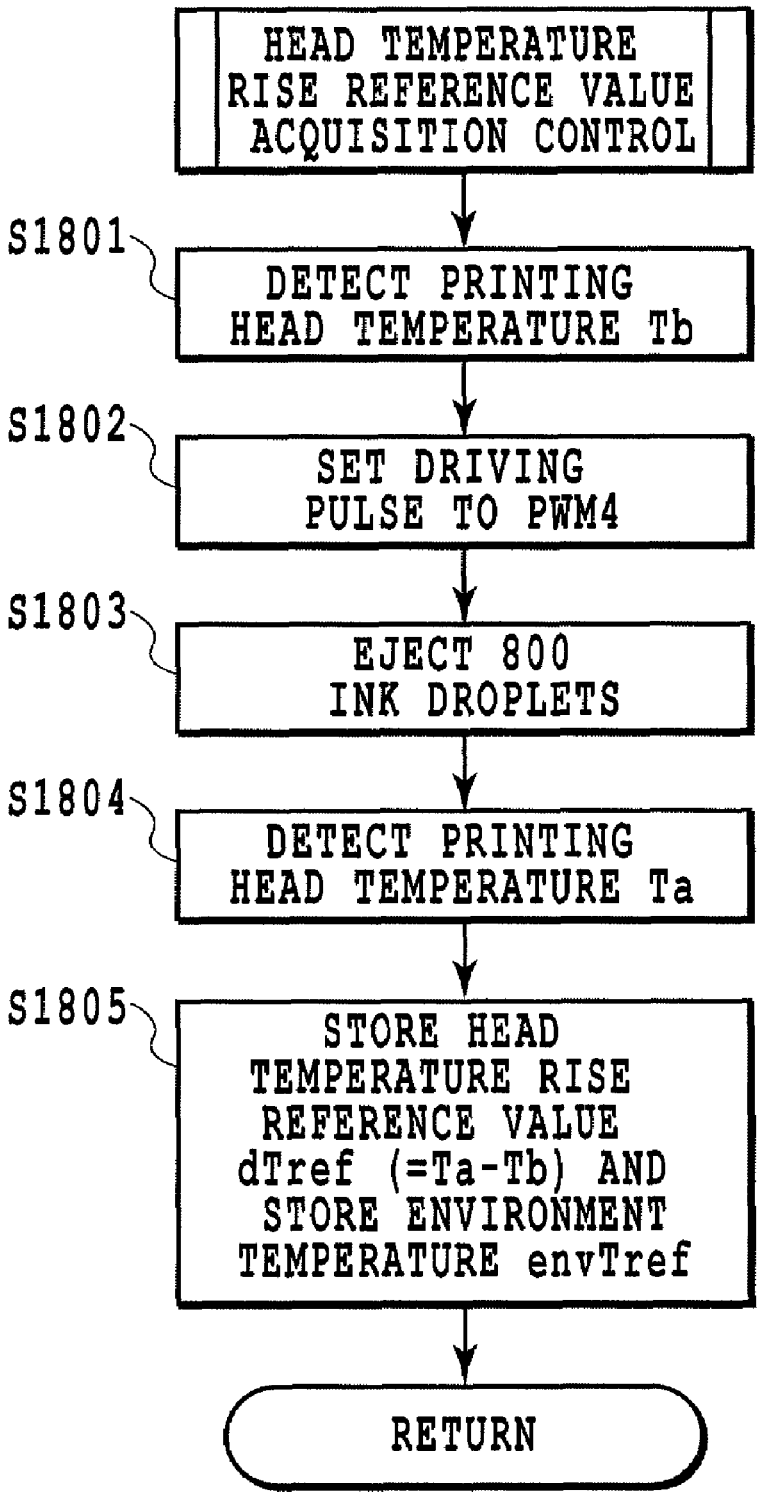
FIG. 18 is a flowchart for describing a head temperature rise reference value acquisition control in FIG. 17.

The head temperature rise reference value acquisition control is described in detail in FIG. 18. In the head temperature rise reference value acquisition control, firstly, a printing head temperature before ink ejection (Tb) is detected on the basis of an output from the diode sensor 208 in a step S1801. Next, a driving pulse to be applied to the heater 212 is set to PWM4 in a step S1802.

Figures 19A, 19B:
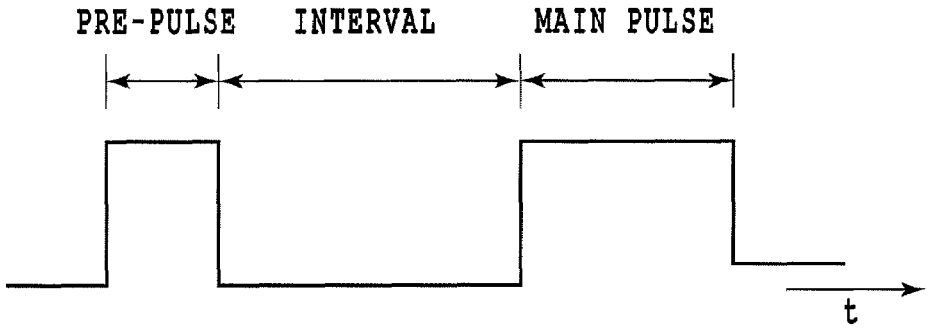
FIG. 19A is an explanatory drawing of the relationship between an environment temperature and driving pulse in the head temperature rise reference value acquisition control in FIG. 18.
FIG. 19B is an explanatory drawing of pre-pulse, interval, and main pulse in FIG. 19A.

In the following section, the PWM control will be described. In general, if a uniform driving pulse is applied to drive a heater, an amount of ink ejected from one nozzle would be smaller in a low temperature environment than in a high temperature environment due to the characteristics of ink. In the meantime, it is known that, if a pulse is applied to a heater in multiple times and a width of a pulse which is applied first is set to be longer, an amount of ink ejected would be increased (for example, see, Japanese Patent Laid-Open No. Hei 7-323552). Therefore, in the present embodiment, a driving pulse is selected according to the printing environment, such as PWM4 having a long pre-pulse width is selected for driving in a low temperature environment lower than 18° C., whereas PWM1 having a short pre-pulse width is selected for driving in a high temperature environment equal to or higher than 28° C., as shown in FIGS. 19A and 19B. Therefore, printing is carried out with a constant amount of ink ejected regardless of printing environment.

However, regarding the remaining ink amount estimation control, environment temperatures at which a head temperature rise reference value is acquired and at which a remaining ink amount is actually estimated are different in some cases. In such a case, it is possible that the head temperature rise property obtained as a reference value is off by an amount of a driving pulse. In the meantime, an amount of ink to be ejected per unit time for the remaining ink amount estimation in the present case is set to be larger than that for printing. For these reasons, a driving pulse is set to PWM4 in the step S1802.

After the driving pulse has been set, 800 ink droplets are ejected from 600 cyan ink ejecting nozzles in the printing head 101 in a step S1803. A printing head temperature after the ink ejection (Ta) is detected in a step S1804. After the printing head temperatures before and after the ink ejection are detected, a value, (Ta−TB), is stored in the RAM 302 as a head temperature rise reference value, dTref, in the case where there is a sufficient remaining ink amount. An environment temperature, envTref, at which the head temperature rise reference value acquisition control has been conducted, is also stored in the RAM 302. The environment temperature is stored as a countermeasure for variable head temperature rise property due to an environment temperature, and will be used as a correction parameter in later remaining ink amount estimation.

Referring back to FIG. 17, the description will be continued. After acquisition of the head temperature rise reference value, the operation proceeds to the step S1704, and it is determined whether or not there is data to be printed on the following page. Once reaching the step S1708 after steps S1701, S1705, S1706, and S1707, the operation proceeds to a step S1710 because the head temperature rise reference value has already been acquired. In the step S1710, it is determined whether or not the remaining ink amount is less than 1.5 g. This value, 1.5 g, is a minimum amount required to determine that there is a sufficient amount of ink to print data on an A4-size page in the 12-pass printing mode even allowing for a maximum tolerance of a theoretical value for the amount of ink having been consumed. In the case where the remaining ink amount has been determined to be at least 1.5 g in the step S1710, the operation proceeds to the step S1704, and it is determined whether or not there is data to be printed on the following page. On the other hand, in the case where the remaining ink amount has been determined to be less than 1.5 g in the step S1710, it is possible that the remaining ink amount is not sufficient for printing data on the following page. Therefore, the operation proceeds to a step S1711 to carry out a remaining ink estimation control 4.

Figure 20:
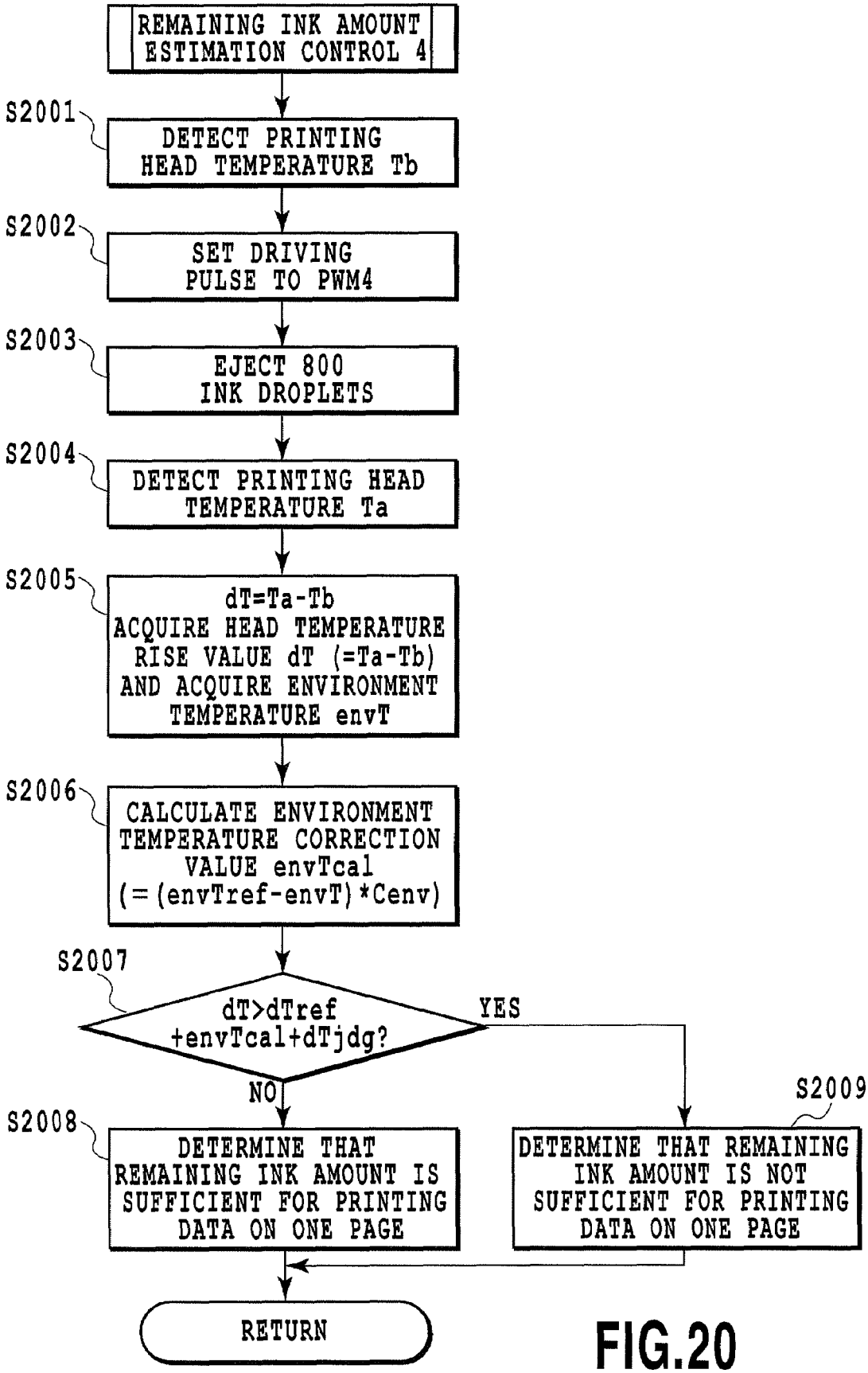
FIG. 20 is a flowchart for describing a remaining ink amount estimation control 4 in FIG. 17.

The remaining ink estimation control 4 is described in detail in FIG. 20. Although a heater driving operation in the remaining ink estimation control 4 is the same as that in the above-described head temperature rise reference value acquisition control, the overall operation will be sequentially described. A printing head temperature before ink ejection (Tb) is detected on the basis of an output of the diode sensor 208 in a step S2001. Then, the driving pulse is set to PWM4 in a step S2002. After the pulse has been set, 800 ink droplets are ejected from 600 cyan ink ejecting nozzles in the printing head 101 in a step S2003. In a step S2004 after completion of the ink ejection, a printing head temperature after the ink ejection (Ta) is detected. After the printing head temperatures before and after the ink ejection are calculated, a value, (Ta−Tb), is acquired as a head temperature rise value dT in a step S2005, and the environment temperature at this point is acquired as an environment temperature, envT.

Figure 21:
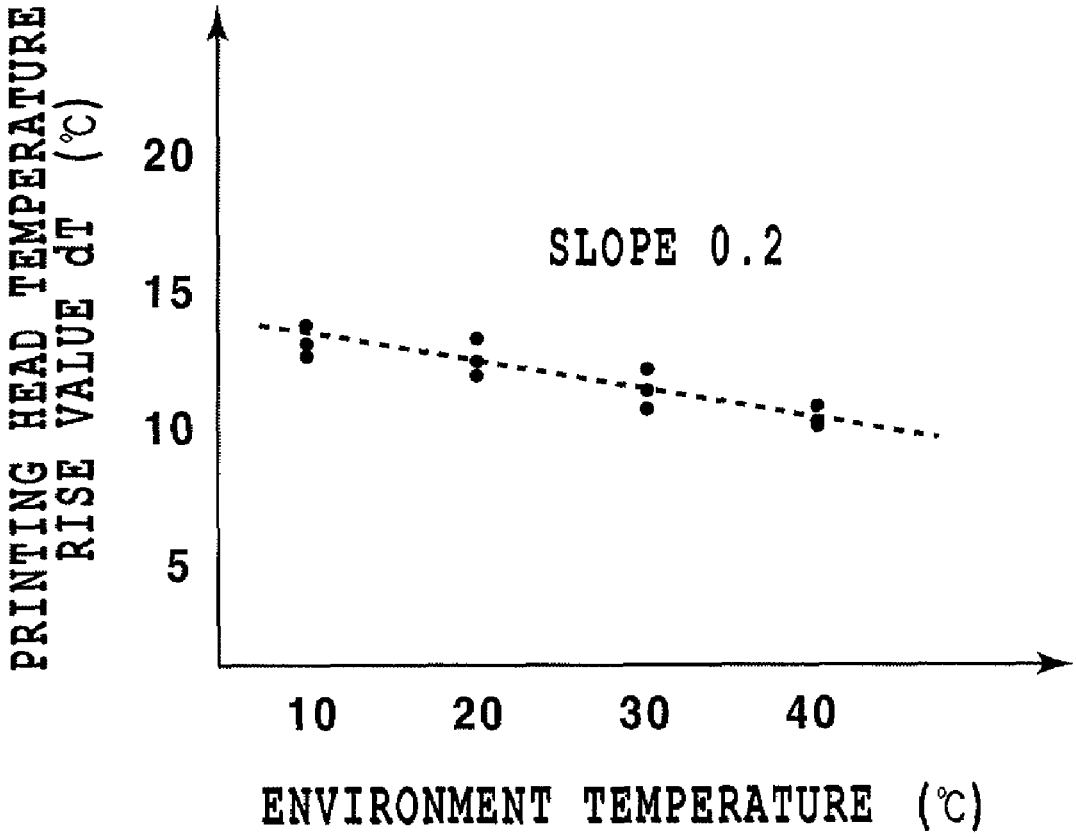
FIG. 21 is an explanatory drawing of temperature rising values of a printing head measured for different environment temperatures.

The remaining ink amount is to be determined after acquiring these parameters. For the determination, firstly, a parameter is calculated which corrects a change in the head temperature rise property due to a difference between environment temperatures at which the head temperature rise reference value acquisition control was carried out and at which the remaining ink amount estimation control 4 was carried out. An environment temperature correction value (envTcal) is obtained by the following two of calculations. Firstly, subtract the environment temperature (envT) at which the remaining ink amount estimation control 4 was carried out from the environment temperature (envTref) at which the head temperature rise reference value acquisition control was carried out. Then secondly, multiply the resultant value with a constant number, Cenv. FIG. 21 shows the result of measurement of a head temperature rise value (dT), which was obtained when 800 ink droplets were ejected at an ejection frequency of 12 kHz with a sufficient amount of ink in an ink tank, at various environment temperatures. As shown in FIG. 21, the constant number, Cenv, is calculated from the degree of the slope of the relationship between head temperature rise property and environment temperature. The constant number, Cenv, in the present case is 0.2.

In a step S2007 after calculating the environment temperature correction value, it is determined whether or not the head temperature rise value (dT) at which the remaining ink amount estimation control 4 was carried out is larger than a sum of the head temperature rise reference value (dTref), the environment temperature correction value (envTcal), and an ink availability judgment value (dTjdg). The ink availability judgment value (dTjdg) is a temperature difference between printing head temperatures (Ta) required to determine whether or not there is a remaining ink. The ink availability judgment value in the first embodiment is 10° C. However, in the present case, it is not necessary to set a higher temperature difference to allow for variations in temperature rise property among individual printing heads and in temperature reading accuracy among individual diode sensors, since the head temperature rise reference value has already been acquired. Therefore, the ink availability judgment value (dTjdg) can be set to below 10° C. In the present embodiment, the ink availability judgment value (dTjdg) is set to 5° C. to allow for variation in the number of tests carried out. With this value, the above-described sum of the values to be compared with the head temperature rise value (dT) can be set to be lower; thus, it is possible to reduce an amount of ink to be used in the remaining ink amount estimation control.

When a head temperature rise value (dT) at which the remaining ink amount estimation control 4 is carried out is smaller than the sum of the three values described above, the operation proceeds to a step S2008, and it is determined that the remaining ink amount is sufficient for printing data on one page. On the other hand, when a head temperature rise value (dT) is larger than the sum of the three values described above, the operation proceeds to a step S2009, and it is determined that there is no remaining ink sufficient for printing data on one page.

At this point, back to FIG. 17, the operation proceeds to a step S1712. In the step S1712, it is determined whether or not a remaining ink is sufficient for printing data on one page according to the result of determination in the remaining ink estimation control 4. If a remaining ink amount is determined to be sufficient, the operation proceeds to the step S1704, and it is determined whether or not there is data to be printed on the following page. If a remaining ink amount is determined to be not sufficient, the operation proceeds to a step S1713. In the step S1713, a user is notified that ink ran out by being indicated on the display panel through the host apparatus, data yet to be printed after the current page are stored in RAM, and then the printing is terminated.

Figure 22:
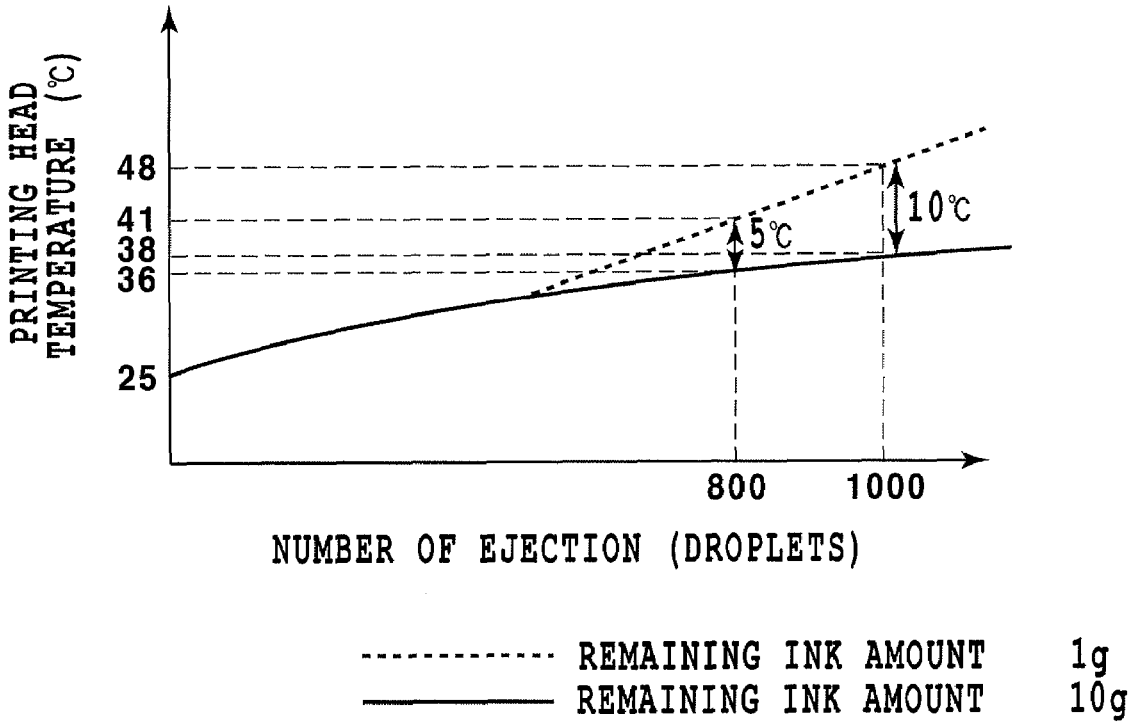
FIG. 22 is an explanatory drawing of the relationship between the number of ink droplets to be ejected and a printing head temperature.

The present embodiment allows a temperature difference between printing head temperatures after ink ejection (Ta) to be smaller by measuring a specific temperature rise property of the printing head in the state where it is certainly determined that there is a remaining ink. Hence, it is possible to reduce an amount of ink consumed in the remaining ink estimation control. To be more specific, FIG. 22 shows a transition of a printing head temperature when the heater is driven at an ejection frequency of 12 kHz. The remaining ink amount required for determining that there is a sufficient amount of ink to print data on an A4-size page in the 12-pass printing mode is 1 g. Therefore, while the number of ink droplets to be ejected in the remaining ink amount estimation is 1,000 with an ink availability judgment value set to 10° C., the number can be reduced to 800 in the present case.

By having the configuration described above, it is possible to estimate a remaining ink amount in high accuracy while restraining a consumption of ink. It should be noted that an ejection frequency is fixed to 12 kHz both for printing and for estimation of a remaining ink amount in the present embodiment. Alternatively, it is possible to further reduce an amount of ink required for estimation of a remaining ink amount by employing an ejection frequency higher than 12 kHz.

Other Embodiments

The inkjet printing apparatus to which the present invention can be applied is not limited to so-called serial scan-type printing apparatuses, and may be so-called full-line type printing apparatuses. In other words, as long as having a configuration in which a change occurs in the state of the printing head or the ink tank (a change in the amount of ink ejected while the ink is being ejected) in response to changes in the amount of ink available for supply to the ejection openings, the printing apparatus is not limited by the printing method.

Furthermore, regarding the ink ejection for estimation of a remaining ink amount, the method for setting the amount of the ink to be ejected per unit time during the estimation to be larger than that during printing is not limited only to the above-described method for increasing the ejection frequency of the ink. For example, a method for increasing the number of ejection openings used in the ink ejection may also be adopted. Furthermore, the combination of a method for increasing the ejection frequency and that for increasing the number of ejection openings may be adopted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-123666, filed May 8, 2007, which is hereby incorporated by reference herein in its entirety.

What is claimed is:

1. A printing apparatus for performing printing on a printing medium by ejecting ink supplied by an ink tank from ejection openings of a printing head, comprising:

an acquisition unit that acquires a temperature change of the printing head between before and after ejection of ink not contributing to printing; and an estimation unit that estimates a remaining ink amount based on the acquired temperature change of the printing head, wherein an amount of ink ejected per unit time during the ejection of ink not contributing to printing is larger than an amount of ink ejected per unit time during the printing.

2. The printing apparatus according to claim 1, wherein the amount of ink ejected during the ejection of ink not contributing to printing is reduced, as an amount of ink available for supply is reduced.

3. The printing apparatus according to claim 1, wherein a less amount of the ink is supplied to the ejection openings, as an amount of ink available for supply is reduced.

4. The printing apparatus according to claim 1, further comprising a second estimation unit that estimates an amount of ink available for supply in a method different from that of said estimation unit, wherein said estimation unit estimates the remaining ink amount on the basis of the acquired temperature change of the printing head, when the amount of ink available for supply estimated by said second estimation unit is smaller than a reference value.

5. The printing apparatus according to claim 1, wherein the amount of ink to be ejected per unit time during the ejection of ink not contributing to printing is made larger than the amount of ink ejected per unit time during the printing, by changing at least any one of an ejection frequency of ink droplets and the number of the ejection openings to be used for the ejection of ink not contributing to printing.

6. The printing apparatus according to claim 1, wherein an amount of ink to be ejected during the ejection of ink not contributing to printing varies in accordance with at least any one of a maximum amount of ink ejected, the number of printing passes, an ejection frequency of ink droplets, the number of the ejection openings to be used, and a degree of thinning of data to be printed, a size of the printing medium, and an amount of data to be printed, for printing in a predetermined unit after the ejection of ink not contributing to printing.

7. The printing apparatus according to claim 1, further comprising a judgment unit that judges, on the basis of an amount of ink available for supply estimated by said estimation unit, whether or not printing in a predetermined unit can be performed.

8. The printing apparatus according to claim 1, further comprising a alteration unit that alters a printing condition during the printing on the basis of an amount of ink available for supply estimated by said estimation unit.

9. The printing apparatus according to claim 8, wherein the printing condition is the number of printing passes.

10. The printing apparatus according to claim 1, further comprising a second estimation unit that estimates an amount of ink available for supply in a method different from that of said estimation unit; and a measuring unit that measures a temperature property of the printing head when the amount of ink available for supply estimated by said second estimation unit is larger than a reference value, and wherein said second estimation unit estimates the remaining ink amount on the basis of the temperature change of the printing head and the temperature property of the printing head.

11. An estimation method of an ink amount, in a printing apparatus for performing printing on a printing medium by ejecting ink supplied by an ink tank from ejection openings of a printing head, for estimating an amount of ink available for supply to the ejection openings, the method comprising:

an acquisition process for acquiring a temperature change of the printing head between before and after the ejection of ink not contributing to printing; and an estimation process for estimating a remaining ink amount on the basis of the temperature change of the printing head which is acquired in said acquisition process, and wherein an amount of ink ejected per unit time during the ejection of ink not contributing to printing is larger than an amount of ink ejected per unit time during the printing.

* * * * *